US010453376B2

(12) United States Patent
Ozaki et al.

(10) Patent No.: US 10,453,376 B2
(45) Date of Patent: Oct. 22, 2019

(54) IMAGE DISPLAY DEVICE AND METHOD FOR DRIVING THE SAME

(71) Applicant: Japan Display Inc., Minato-ku (JP)

(72) Inventors: Tadafumi Ozaki, Minato-ku (JP); Kazuhiko Sako, Minato-ku (JP); Tsutomu Harada, Minato-ku (JP); Naoyuki Takasaki, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 209 days.

(21) Appl. No.: 15/442,995

(22) Filed: Feb. 27, 2017

(65) Prior Publication Data

US 2017/0270846 A1 Sep. 21, 2017

(30) Foreign Application Priority Data

Mar. 18, 2016 (JP) ..... 2016-054994

(51) Int. Cl.
*G09G 3/20* (2006.01)

(52) U.S. Cl.
CPC ... *G09G 3/2059* (2013.01); *G09G 2320/0247* (2013.01)

(58) Field of Classification Search
None
See application file for complete search history.

(56) References Cited

U.S. PATENT DOCUMENTS

2002/0106102 A1* 8/2002 Au ..... G06T 1/005 382/100
2005/0030586 A1* 2/2005 Huang ..... H04N 1/405 358/2.1
2012/0182305 A1 7/2012 Tsuzaki et al.

FOREIGN PATENT DOCUMENTS

JP 2012-145821 8/2012

* cited by examiner

*Primary Examiner* — Aaron M Richer
(74) *Attorney, Agent, or Firm* — Oblon, McClelland, Maier & Neustadt, L.L.P.

(57) ABSTRACT

An image display device includes a first pixel data calculator calculating first pixel data for a pixel of attention based on a first error value for a pixel adjacent thereto in the same error diffusion block; a second pixel data calculator calculating second pixel data for the pixel of attention based on a corrected error value for the adjacent pixel; a first error value calculator calculating the first error value based on the first pixel data; a second error value calculator calculating a second error value based on the second pixel data; and a corrected error value calculator calculating the corrected error value by correcting the second error value in a direction in which the second error value approaches the first error value in accordance with whether the pixel of attention is located within a predetermined range from a border among a plurality of error diffusion blocks.

9 Claims, 17 Drawing Sheets

FIG.15A

| | |
|---|---|
| -2 | +2 |
| +2 | -2 |

FIG.15B

| | m-2 | m-1 | m | m+1 |
|---|---|---|---|---|
| n+2 | 5 | 217 | 57 | 135 |
| n+1 | 79 | 12 | 91 | 183 |
| n | 117 | 235 | 168 | 81 |
| n-1 | 159 | 213 | 39 | 200 |

FIG.15C

| | m-2 | m-1 | m | m+1 |
|---|---|---|---|---|
| n+2 | 3 | 219 | 55 | 137 |
| n+1 | 81 | 10 | 93 | 181 |
| n | 115 | 237 | 166 | 83 |
| n-1 | 161 | 211 | 41 | 198 |

IMAGE DISPLAY DEVICE AND METHOD FOR DRIVING THE SAME

CROSS REFERENCE TO RELATED APPLICATIONS

This application is based upon and claims the benefit of priority from the prior Japanese Patent Application No. 2016-054994, filed on Mar. 18, 2016, the entire contents of which are incorporated herein by reference.

FIELD

The present invention relates to an image display device and a method for driving the image display device.

BACKGROUND

For a display of, for example, a mobile electronic device such as a mobile phone or a mobile information terminal, a personal computer, a television receiver or the like, a monochrome or color liquid crystal display panel, an electroluminescence display panel using electroluminescence of an inorganic or organic material, a plasma display panel or the like is used.

In the case where the gray scale display capability of pixels of such a display is low, in other words, in the case where the number of gray scale levels of the display is small, a contour-like line is displayed at a border of different gradation levels of an image, which deteriorates the image quality. It is known that use of an error diffusion method improves the image quality in such a case.

According to the "error diffusion method", an error caused when multi-value image data is converted into, for example, binary image data (i.e., difference between the multi-value image data and the binary image data) is "diffused" by multiplying a plurality of pixels adjacent to the pixel corresponding to the data by a weight coefficient. With the error diffusion method, an error caused between a multi-level original image and, for example, a binary half-tone image is minimized in an averaged manner, and thus a half-tone image having a high image quality is generated.

In the meantime, the error diffusion method has a problem that even in the case where only a part of the original image is changed, the change caused by the error diffusion is propagated over a wide range of the image, which provides a viewer with an impression that the image flickers. This problem is conspicuous in the case where, for example, a moving image is embedded in a part of the image whereas the remaining part of the image is still.

SUMMARY

An image display device in an embodiment according to the present invention includes a display plane including a plurality of pixels located in a matrix, the display plane being divided into a plurality of error diffusion blocks; a storage unit having, stored on the storage unit, a first error value and a corrected error value for each of the pixels; a first pixel data calculator calculating first pixel data based on input data corresponding to a pixel of attention, among the plurality of pixels, and the first error value stored on the storage unit for each of pixels, among a predetermined number of pixels adjacent to the pixel of attention in a predetermined direction, belonging to the same error diffusion block as the pixel of attention; a second pixel data calculator calculating second pixel data based on the input data corresponding to the pixel of attention and the corrected error value stored on the storage unit for each of the predetermined number of pixels adjacent to the pixel of attention in the predetermined direction; a first quantized data calculator calculating first quantized data as a result of quantization of the first pixel data; a second quantized data calculator calculating second quantized data as a result of quantization of the second pixel data; a first error value calculator calculating the first error value based on a difference between the first pixel data and the first quantized data; a second error value calculator calculating a second error value based on a difference between the second pixel data and the second quantized data; a determination unit determining whether or not the pixel of attention is located within a predetermined range from a border among the plurality of error diffusion blocks; and a corrected error value calculator calculating the corrected error value for the pixel of attention by correcting the second error value in a direction in which the second error value approaches the first error value, in accordance with a determination result provided by the determination unit.

An image display device in an embodiment according to the present invention includes a display plane including a plurality of pixels located in a matrix, the display plane being divided into a plurality of error diffusion blocks; a first error value calculator calculating, for a pixel of attention among the plurality of pixels, a first error value limited to within the plurality of error diffusion blocks; a second error value calculator calculating, for the pixel of attention, a second error value not limited to within the plurality of error diffusion blocks; a determination unit determining whether or not the pixel of attention is located within a predetermined range from a border among the plurality of error diffusion blocks; a corrected error value calculator calculating a corrected error value for the pixel of attention by correcting the second error value in a direction in which the second error value approaches the first error value, in accordance with a determination result provided by the determination unit; and a pixel data calculator calculating pixel data for another pixel, among the plurality of pixels, adjacent to the pixel of attention based on the corrected error value.

A method for driving an image display device in an embodiment according to the present invention is a method for driving an image display device including a display plane including a plurality of pixels located in a matrix, the display plane being divided into a plurality of error diffusion blocks. The method includes storing a first error value and a corrected error value for each of the pixels on a storage unit; calculating first pixel data based on input data corresponding to a pixel of attention, among the plurality of pixels, and the first error value stored on the storage unit for each of pixels, among a predetermined number of pixels adjacent to the pixel of attention in a predetermined direction, belonging to the same error diffusion block as the pixel of attention; calculating second pixel data based on the input data corresponding to the pixel of attention and the corrected error value stored on the storage unit for each of the predetermined number of pixels adjacent to the pixel of attention in the predetermined direction; calculating first quantized data as a result of quantization of the first pixel data; calculating second quantized data as a result of quantization of the second pixel data; calculating the first error value based on a difference between the first pixel data and the first quantized data; calculating a second error value based on a difference between the second pixel data and the second quantized data; determining whether or not the pixel of attention is located within a predetermined range from a border among the plurality of error diffusion blocks; and calculating the corrected error value for the pixel of attention by correcting the second error value in a direction in which the second error value approaches the first error value, in accordance with a result of the determination.

A method for driving an image display device in an embodiment according to the present invention is a method for driving an image display device including a display plane including a plurality of pixels located in a matrix, the display plane being divided into a plurality of error diffusion blocks. The method includes calculating, for a pixel of attention among the plurality of pixels, a first error value limited to within the plurality of error diffusion blocks; calculating, for the pixel of attention, a second error value not limited to within the plurality of error diffusion blocks; determining whether or not the pixel of attention is located within a predetermined range from a border among the plurality of error diffusion blocks; calculating the corrected error value for the pixel of attention by correcting the second error value in a direction in which the second error value approaches the first error value, in accordance with a result of the determination; and calculating pixel data for another pixel, among the plurality of pixels, adjacent to the pixel of attention based on the corrected error value.

BRIEF DESCRIPTION OF DRAWINGS

FIG. 15A through FIG. 15C show specific examples of another embodiment shown in FIG. 14;

DESCRIPTION OF EMBODIMENTS

Figure 1:
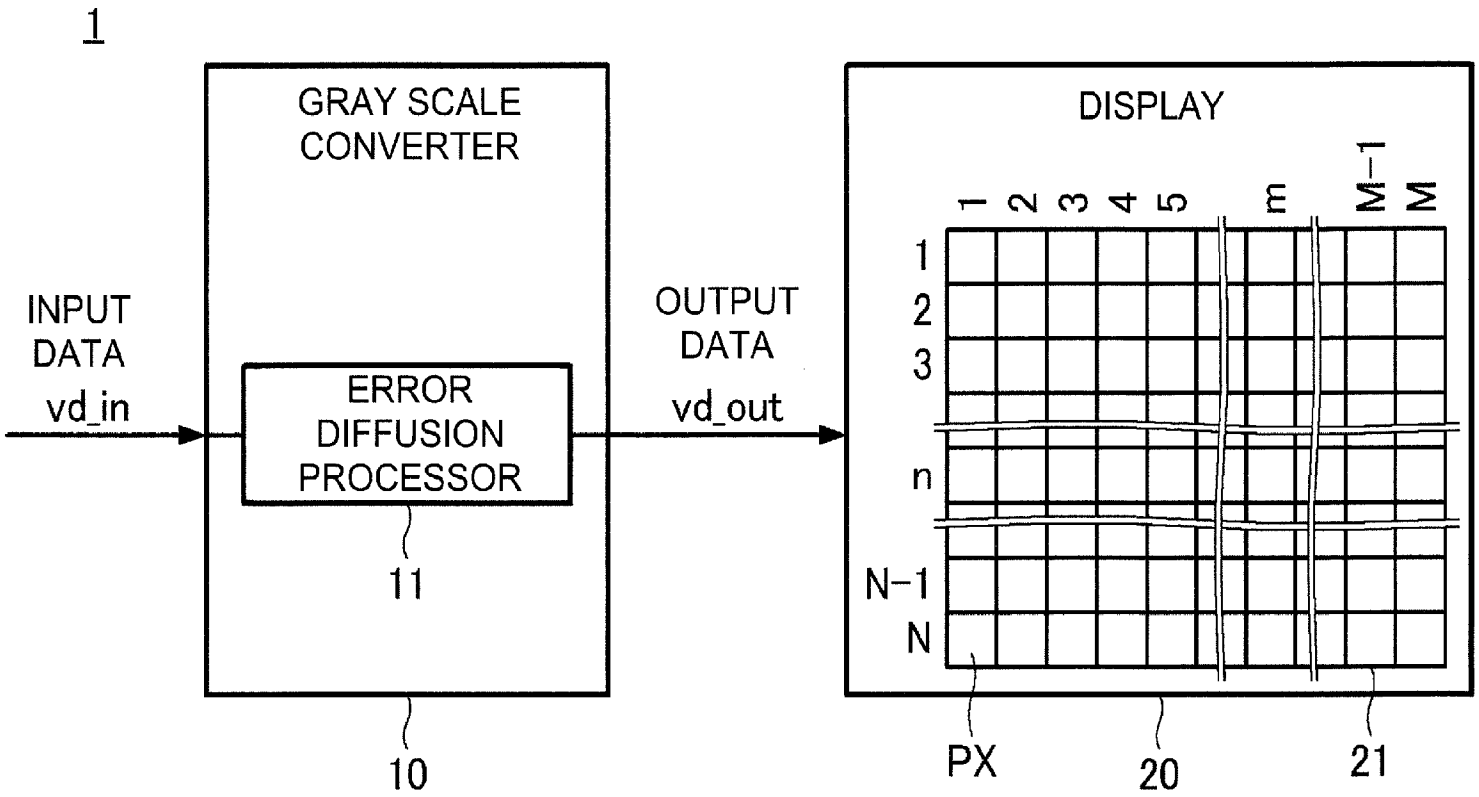
FIG. 1 is a conceptual view of an image display device 1 in an embodiment according to the present invention.

Hereinafter, an image display device in an embodiment according to the present invention will be described in detail with reference to the drawings. The image display device in an embodiment according to the present invention is not limited to the following embodiment and may be carried out in any of various modifications. The ratio of sizes in the drawings may be different from the actual ratio, or a part of the elements may be omitted from the drawings, for the sake of explanation. The present invention is not limited to being applicable to an image display device, and may be applicable for a method for driving an image display device by which the image display device performs each of processes described below, a program for executing the driving method, or a storage medium having such a program stored thereon.

FIG. 1 is a conceptual view of an image display device 1 in this embodiment. As shown in FIG. 1, the image display device 1 includes a display 20, which includes a display plane 21 including a plurality of pixels PX located in a matrix, and a gray scale converter 10 performing a predetermined gray scale conversion process on input data vd_in supplied from an upper-level device (not shown) to generate output data vd_out and supplying the output data vd_out to the display 20.

The display 20 is, for example, a monochrome liquid crystal display panel. There is no specific limitation on the structure or system of the display 20. The display 20 may be a known display device such as, for example, a liquid crystal display panel, an electroluminescence display panel, or a plasma display panel, or may be a display medium such as an electrically rewritable electronic paper or the like. The display 20 may provide monochrome display or color display. In the following description, the display 20 is assumed to provide monochrome display for easier explanation (therefore, it is assumed that one piece of input data vd_in is input to one pixel PX in one frame).

At the display plane 21 of the display 20, M pixels PX are located in a horizontal direction and N pixels PX are located in a vertical direction; namely, M×N pixels PX in total are located in a matrix. In this specification, the expression "X (n, m)" (X is an arbitrary element; n is an integer of 1 to N, and m is an integer of 1 to M) refers to an element X, among a plurality of elements respectively provided for the pixels PX, that corresponds to the pixel PX located at the n'th row and m'th column.

In the case where the display 20 is a transmissive display panel, the display 20 is configured to control the light transmittance of each pixel PX based on a value of the output data vd_out supplied from the gray scale converter 10. This control on the light transmittance controls the amount of light supplied from a light source device (not shown), and as a result, an image is displayed on the display 20. In the case where the display 20 is a reflective display panel, the display 20 is configured to control the light reflectance of each pixel PX based on a value of the output data vd_out supplied from the gray scale converter 10. This control on the light reflectance controls the amount of reflected external light, and as a result, an image is displayed on the display 20.

The gray scale converter 10 includes an error diffusion processor 11 performing a gray scale process by use of an error diffusion method. The gray scale converter 10 is configured to convert input data vd_in (n, m) into output data vd_out (n, m) by use of the error diffusion processor 11. The output data vd_out (n, m) obtained by the conversion is supplied to the display 20. The details of the conversion process will be described below with reference to FIG. 3 through FIG. 9.

The gray scale converter 10 has, stored thereon, a plurality of error diffusion blocks BL (see FIG. 2A and FIG. 2B), which are a plurality of areas obtained as a result of the display plane 21 being divided. The error diffusion blocks BL are virtual areas, and each define an area in which the error is diffused when the gray scale process is performed by the error diffusion method. It should be noted that in this embodiment, the error diffusion processor 11 does not necessarily diffuse an error in an error diffusion block BL. This will also be described below in detail with reference to FIG. 3 through FIG. 9.

Figure 2A:
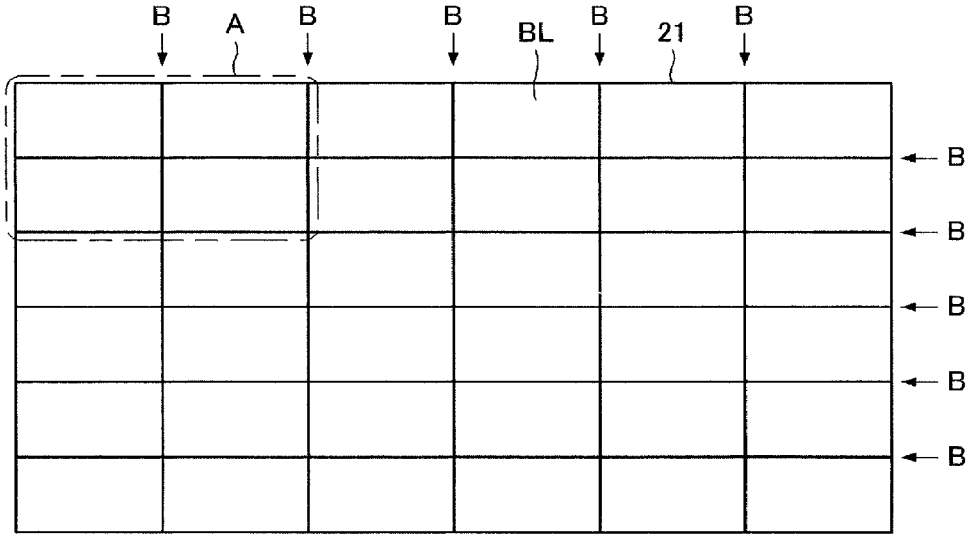
FIG. 2A shows error diffusion blocks BL provided at a display plane 21 of the image display device 1 shown in FIG. 1.
Figure 2B:
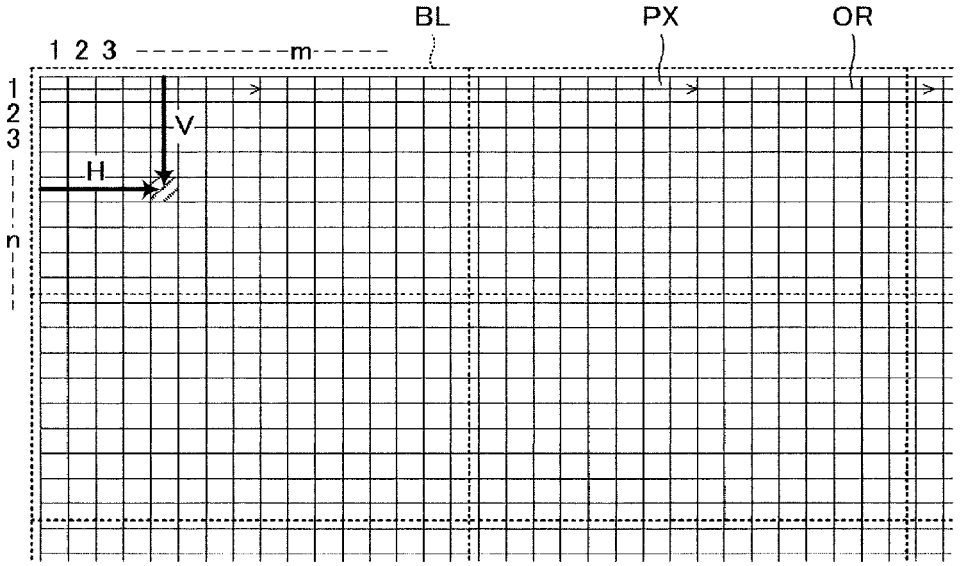
FIG. 2B is an enlarged view of region A shown in FIG. 2A.

FIG. 2A shows the error diffusion blocks BL provided at the display plane 21 shown in FIG. 1. FIG. 2B is an enlarged view of region A shown in FIG. 2A. FIG. 2A omits the pixels PX.

As shown in FIG. 2A, the error diffusion blocks BL in this embodiment have rectangular shapes of the same size. One error diffusion block BL is demarcated from another error diffusion block BL adjacent thereto along a border B. FIG. 2A shows an example in which the display plane 21 is divided into 6×6=36 error diffusion blocks BL. This is merely an example, and there is no limitation on the number of the error diffusion blocks BL in this embodiment according to the present invention. FIG. 2B shows an example in which one error diffusion block BL includes 16×9=144 pixels PX. This is also merely an example, and the there is no limitation on the number of the pixels PX included in each error diffusion block BL in this embodiment according to the present invention.

The gray scale converter 10 is supplied with the input data vd_in (n, m). The input data vd_in is sequentially supplied in the order from the input data vd_in for the first row (in the order in which the value of n increases one by one; from top to bottom). Regarding each of the rows, the input data vd_in (n, m) is sequentially supplied in the order shown by arrow OR in FIG. 2B (in the order in which the value of m increases one by one; from left to right). The error diffusion processor 11 in the gray scale converter 10 is configured to convert the input data vd_in (n, m) supplied sequentially in this manner into the output data vd_out (n, m) on a pixel-by-pixel basis and supply the output data vd_out (n, m) to the display 20.

Figure 3:
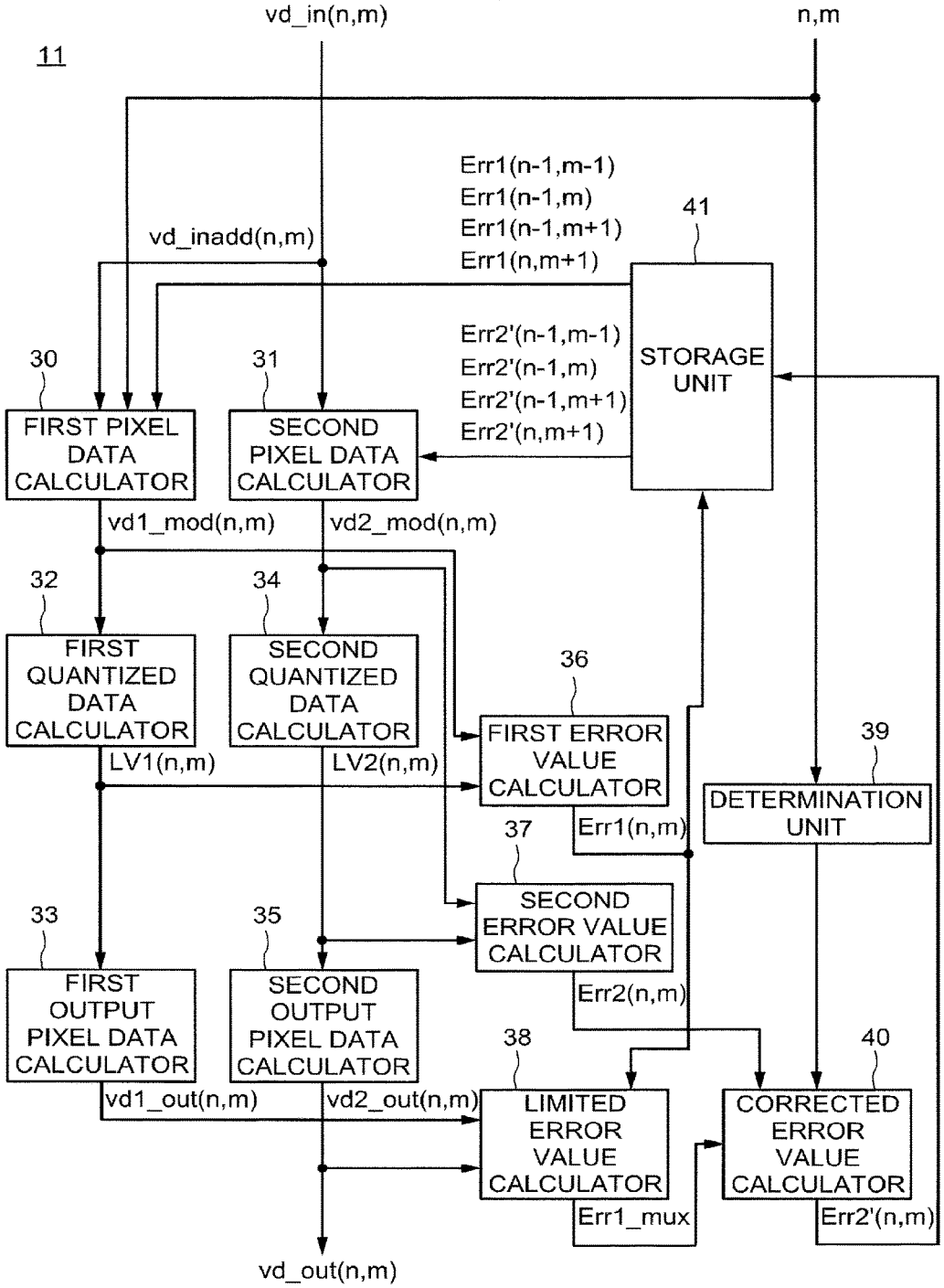
FIG. 3 is a schematic block diagram showing functional blocks of an error diffusion processor 11 of the image display device 1 shown in FIG. 1.

FIG. 3 is a schematic block diagram showing functional blocks of the error diffusion processor 11. As shown in FIG. 3, the error diffusion processor 11 includes a first pixel data calculator 30, a second pixel data calculator 31, a first quantized data calculator 32, a first output pixel data calculator 33, a second quantized data calculator 34, a second output pixel data calculator 35, a first error value calculator 36, a second error value calculator 37, a limited error value calculator 38, a determination unit 39, a corrected error value calculator 40, and a storage unit 41.

The storage unit 41 is configured to store a first error value Err1 (*n, m*) and a corrected error value Err2' (*n, m*) for each pixel PX. These values are calculated respectively by the first error value calculator 36 and the corrected error value calculator 40 while the gray scale process is performed sequentially for each pixel PX.

The first pixel data calculator 30 calculates first pixel data dv1_mod (n, m) for each of the plurality of pixels PX. In the following description, the pixel PX for which the first pixel data or any other data is to be calculated, namely, the pixel PX (n, m), may be referred to as a "pixel of attention". The first pixel data calculator 30 calculates the first pixel data dv1_mod (n, m) based on the input data vd_in (n, m) corresponding to the pixel PX (n, m) (pixel of attention) and the first error value Err1 stored on the storage unit 41 for each of pixels PX, among a predetermined number of pixels adjacent to the pixel PX (n, m) (pixel of attention) in a predetermined direction, that belong to the same error diffusion block BL as the pixel PX (n, m) (pixel of attention). This will be described below in detail with reference to FIG. 5 and FIG. 6A through FIG. 6D. Here, this will be described briefly. In the process performed by the first pixel data calculator 30, the range of pixels, the first error value Err1 for which is to be referred to, is limited to the "pixels belonging to the same error diffusion block BL as the pixel PX (n, m)". In this manner, the first pixel data calculator 30 limits the range in which the error is diffused (diffusion range of the error) to the same error diffusion block BL as the pixel PX (n, m). Therefore, the first pixel data vd1_mol (n, m) is calculated by limiting the diffusion range of the error to the same error diffusion block BL as the pixel PX (n, m).

The second pixel data calculator 31 calculates second pixel data vd2_mod (n, m) based on the input data vd_in (n, m) and the corrected error value Err2' stored on the storage unit 41 for each of the predetermined number of pixels adjacent to the pixel PX (n, m) in the predetermined direction. Unlike the first pixel data calculator 30, the second pixel data calculator 31 does not limit the range of pixels, the corrected error value Err2' for which is to be referred to, to the "pixels belonging to the same error diffusion block BL as the pixel PX (n, m)". Therefore, the second pixel data vd2_mol (n, m) is calculated without limiting the diffusion range of the error to the same error diffusion block BL as the pixel PX (n, m).

The first quantized data calculator 32 calculates first quantized data LV1 (*n, m*) as a result of quantization of the first pixel data vd1_mod (n, m) calculated by the first pixel data calculator 30. The first output pixel data calculator 33 converts the first quantized data LV1 (*n, m*) into 3-bit data to provide first output pixel data vd1_out (n, m). The details of these processes will be described below with reference to FIG. 7.

The second quantized data calculator 34 calculates second quantized data LV2 (*n, m*) as a result of quantization of the second pixel data vd2_mod (n, m) calculated by the second pixel data calculator 31. The second output pixel data calculator 35 converts the second quantized data LV2 (*n, m*) into 3-bit data to provide second output pixel data vd2_out (n, m). The details of these processes will also be described below with reference to FIG. 7. As shown in FIG. 3, the second output pixel data vd2_out (n, m) calculated by the second output pixel data calculator 35 is the output data vd_out (n, m) output by the gray scale converter 10.

The first error value calculator 36 calculates the first error value Err1 (*n, m*) based on a difference between the first pixel data vd1_mod (n, m) and the first quantized data LV1

(*n, m*). Specifically, as shown in the following expression (1), the first quantized data LV1 (*n, m*) is subtracted from the first pixel data vd1_mod (n, m), and the result is set as the first error value Err1 (*n, m*).

$$\mathrm{Err1}(n,m)=vd1_\mathrm{mod}(n,m)-LV1(n,m) \quad (1)$$

The first error value Err1 (*n, m*) calculated by the first error value calculator 36 is supplied to the storage unit 41, and is stored on the storage unit 41 as the first error value Err1 corresponding to the pixel PX (n, m) while the error diffusion processor 11 is performing the process on the same frame.

The second error value calculator 37 calculates a second error value Err2 (*n, m*) based on a difference between the second pixel data vd2_mod (n, m) and the second quantized data LV2 (*n, m*). Specifically, as shown in the following expression (2), the second quantized data LV2 (*n, m*) is subtracted from the second pixel data vd2_mod (n, m), and the result is set as the second error value Err2 (*n, m*).

$$\mathrm{Err2}(n,m)=vd2_\mathrm{mod}(n,m)-LV2(n,m) \quad (2)$$

The limited error value calculator 38 calculates a limited error value Err1_mux as a result of limiting the first error value Err1 (*n, m*) in accordance with the value of the first quantized data LV1 (*n, m*) and the value of the second quantized data LV2 (*n, m*). The limited error value Err1_mux is used in a later step when the corrected error value calculator 40 calculates the corrected error value Err2' (*n, m*). The details of the process performed by the limited error value calculator 38 will be described below with reference to FIG. 8.

The determination unit 39 determines whether or not the pixel PX (n, m) is located within a predetermined range from a border among the plurality of error diffusion blocks BL. Specifically, the determination unit 39 makes a determination on a threshold value on a horizontal direction distance H and a vertical direction distance V shown in FIG. 2B to perform the above-described determination. The details of the process performed by the determination unit 39 will also be described below with reference to FIG. 8.

The corrected error value calculator 40 calculates the corrected error value Err2' (*n, m*) for the pixel PX (n, m) by correcting the second error value Err2 (*n, m*) in a direction in which the second error value Err2 (*n, m*) approaches the first error value Err1 (*n, m*) in accordance with the determination result of the determination unit 39. More specifically, in the case where the determination result of the determination unit 39 shows that the pixel PX (n, m) is located within the predetermined range from the border among the plurality of error diffusion blocks BL, the corrected error value calculator 40 corrects the second error value Err2 (*n, m*) in the direction in which the second error value Err2 (*n, m*) approaches the first error value Err1 (*n, m*) to provide the corrected error value Err2' (*n, m*) for the pixel PX (n, m). By contrast, in the case where the determination result of the determination unit 39 shows that the pixel PX (n, m) is not located within the predetermined range from the border among the plurality of error diffusion blocks BL, the corrected error value calculator 40 sets the limited error value Err1_mux calculated by the limited error value calculator 38 as the corrected error value Err2' (*n, m*).

The corrected error value Err2' (*n, m*) calculated by the corrected error value calculator 40 is supplied to the storage unit 41, and is stored on the storage unit 41 as the corrected error value Err2' corresponding to the pixel PX (n, m) while the error diffusion processor 11 is performing the process on the same frame.

The effect provided by the corrected error value calculator 40 calculating the corrected error value Err2' as described above will be described with reference to FIG. 9.

Figure 9:
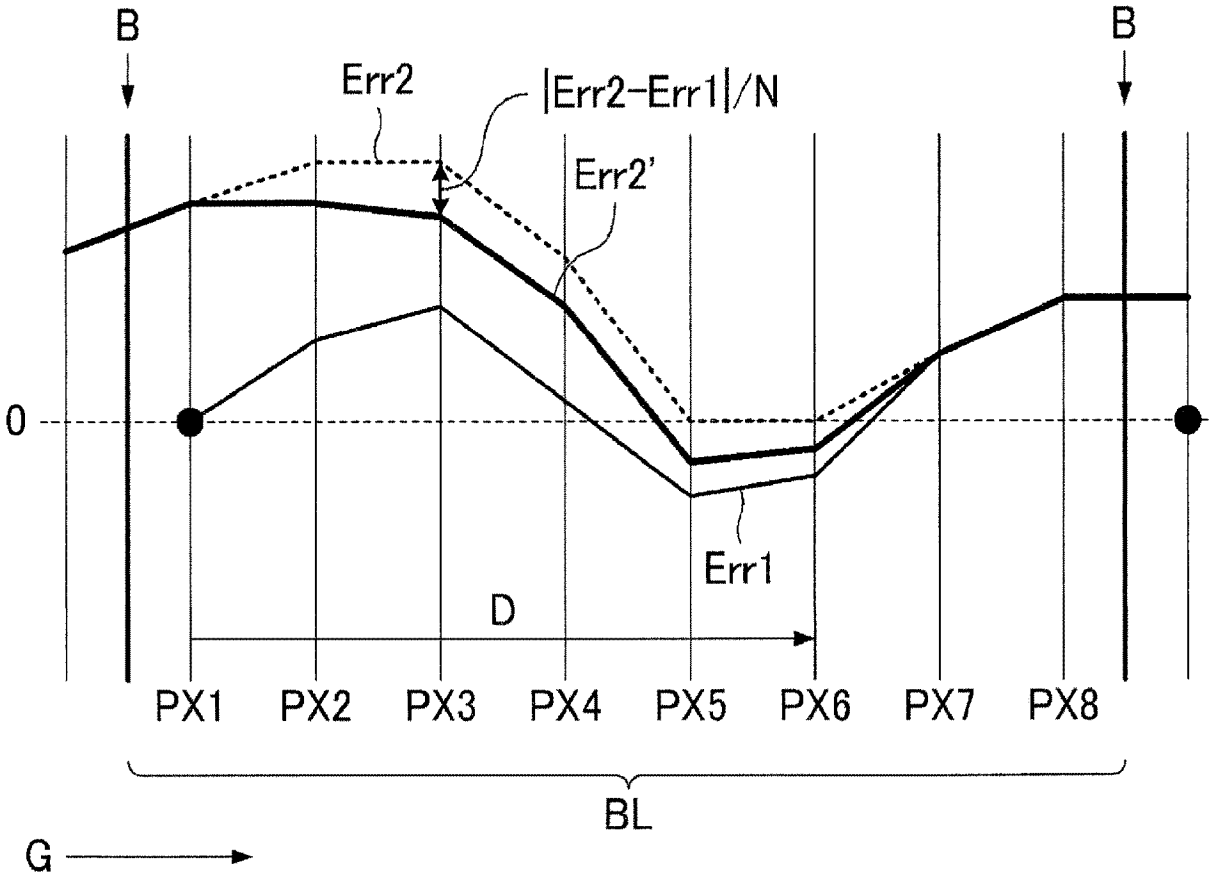
FIG. 9 shows changes in the horizontal direction of Err1 (*n, m*), Err2 (*n, m*) and Err2' (*n, m*) calculated in an embodiment according to the present invention.

FIG. 9 shows changes in the horizontal direction of the first error value Err1, the second error value Err2 and the corrected error value Err2' calculated in an embodiment according to the present invention. For FIG. 9, it is assumed that the horizontal plane 21 is of one dimension extending in the horizontal direction and that one error diffusion block BL includes eight pixels PX1 through PX8 for easier explanation. It is also assumed that the input data vd_in is input sequentially in the order from the pixel located at the left end in FIG. 9 (in the order from the pixel PX1 to the pixel PX8) as represented by arrow G. The above-described predetermined range corresponds to six pixels from the left border B as represented by arrow D.

As shown in FIG. 9, the corrected error value Err2' obtained as a result of the calculation process performed by the corrected error value calculator 40 has the same value as the second error value Err2 for the pixel PX1 closest to the border B of the error diffusion block BL. For the pixels PX2 through PX6 in the predetermined range except for the pixel PX1, the corrected error value Err2' has a value obtained as a result of the second error value Err2 being corrected in a direction in which the second error value Err2 approaches the first error value Err1. For the other pixels PX7 and PX8, the corrected error value Err2' has the same value as the first error value Err1.

The technology described in Japanese Laid Open Patent No. 2012-145821 may be expressed as follows by use of the terms and the like used in this embodiment. The output data vd_out (n, m) is calculated from the first pixel data vd1_mod (n, m), which is calculated based on the first error value Err1. As can be seen from FIG. 9, the first error value Err1 discontinuously changes when crossing the border B. This is a reason why the border between the error diffusion blocks is conspicuous as described above. By contrast, in this embodiment, the output data vd_out (n, m) is generated from the second pixel data vd2_mod (n, m), which is calculated based on the corrected error value Err2'. As can be seen from FIG. 9, the corrected error value Err2' continuously changes even when crossing the border B. Therefore, in this embodiment, the border between the error diffusion blocks BL is suppressed from being conspicuous unlike by the technology described in Japanese Laid Open Patent No. 2012-145821.

Hereinafter, each of the processes performed by the error diffusion processor 11 will be described in more detail with reference to FIG. 4, which is a flow chart.

Figure 4:
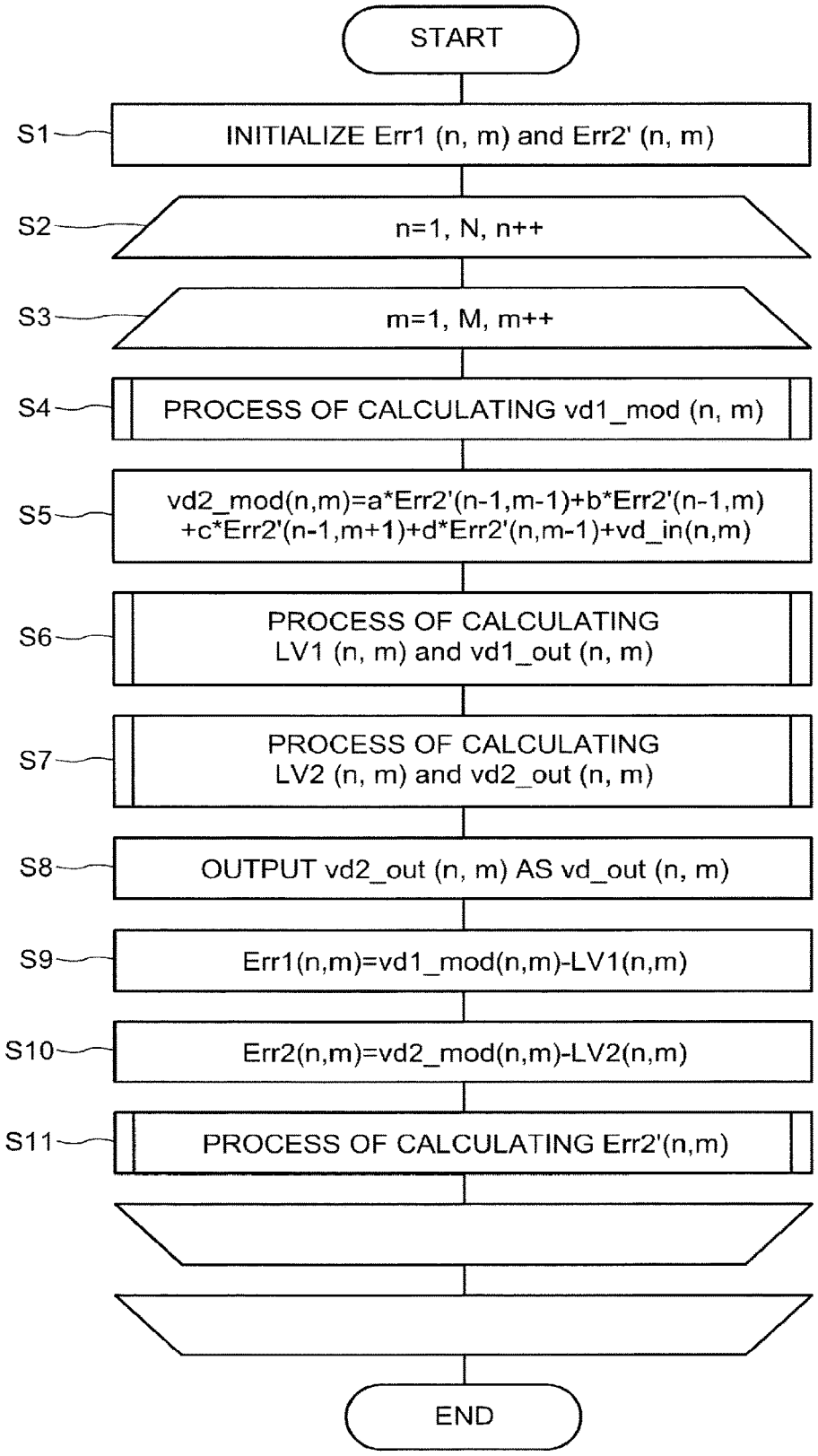
FIG. 4 is a flowchart showing processes performed by the error diffusion processor 11 of the image display device 1 shown in FIG. 1.

FIG. 4 shows processes performed on one frame. As shown in FIG. 4, for starting the processes on a new frame, first, the contents stored on the storage unit 41 are reset (step S1). Then, the input data vd_in (n, m) is supplied from an upper-level device (not shown) while the value of n is incremented one by one from n=1 to n=N and the value of m is incremented one by one from m=1 to m=M for each value of n (steps S2 and S3). The error diffusion processor 11 repeats the processes of steps S4 through S11 described below each time the input data vd_in (n, m) is supplied.

When the input data vd_in (n, m) is supplied, first, the first pixel data calculator 30 performs a process of calculating the first pixel data vd1_mod (n, m) (step S4).

Figure 5:
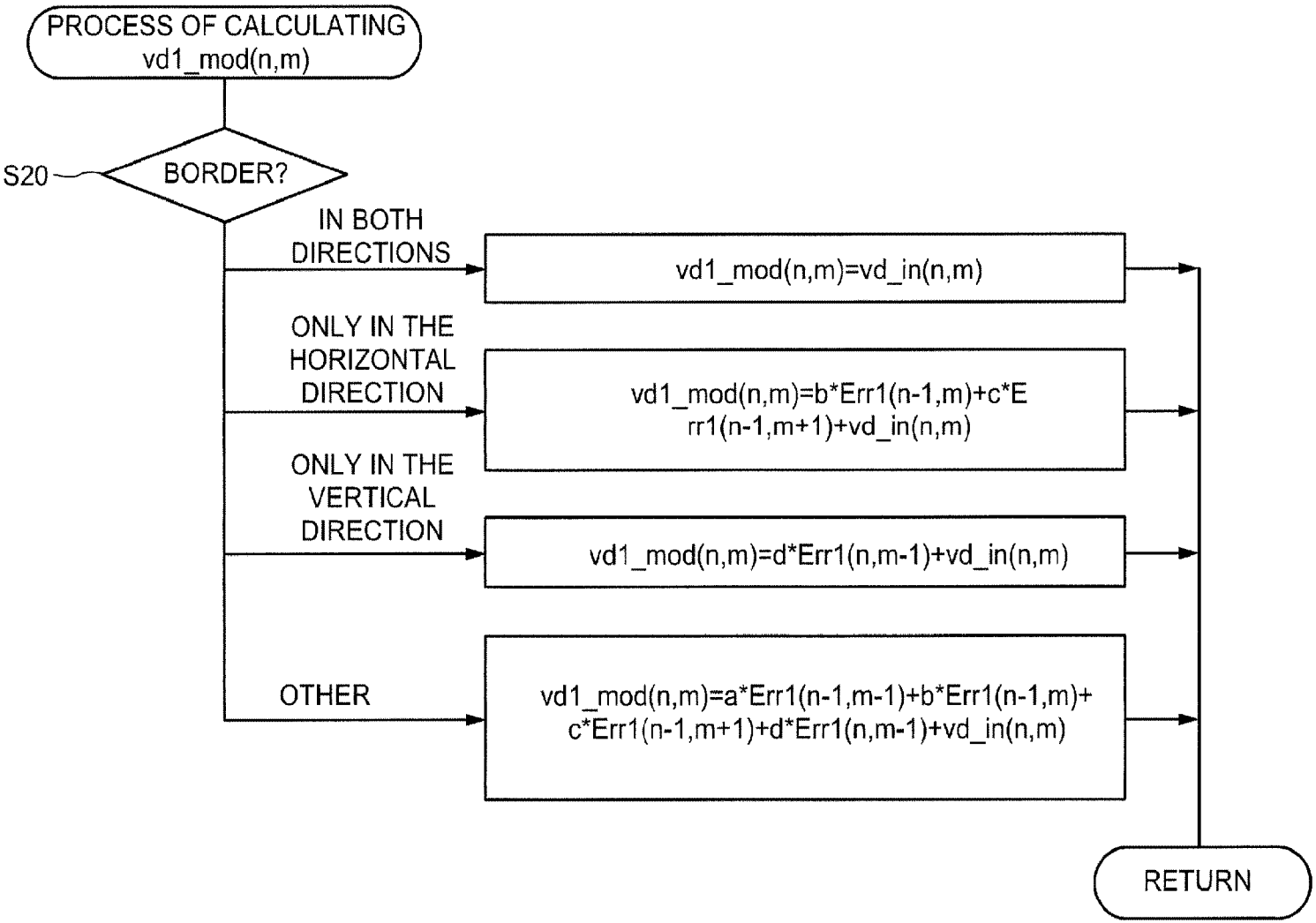
FIG. 5 is a flowchart showing the details of the process of calculating vd1_mod (n, m) shown in FIG. 4.

FIG. 5 is a flowchart showing the details of the process of calculating vd1_mod (n, m). As shown in FIG. 5, the first pixel data calculator 30 first determines the relationship between the pixel PX (n, m) and the border (step S20). The first pixel data calculator 30 calculates the first pixel data vd1_mod (n, m) by use of a different numerical expression in accordance with whether the pixel PX (n, m) is located in contact with both of a border extending in the horizontal direction and a border extending in the vertical direction, in contact with only the border extending in the horizontal direction, in contact with only the border extending in the vertical direction, or in contact with neither the border extending in the horizontal direction nor the border extending in the vertical direction. In FIG. 5, the numerical expression used for calculating the first pixel data vd1_mod (n, m) in the case of "only in the horizontal direction" may be the same as the numerical expression used in the case of "in both directions".

Figure 6A:
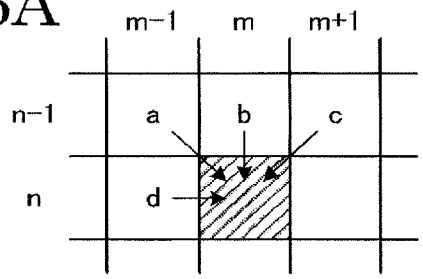
FIG. 6A through FIG. 6D respectively show methods for calculating vd1_mod (n, m) in various cases shown in FIG. 5.

FIG. 6A through FIG. 6D respectively show the methods for calculating the first pixel data vd1_mod (n, m) in the various cases shown in FIG. 5. FIG. 6A shows the case where the pixel PX (n, m) is not located in contact with the border extending in the horizontal direction or the border extending in the vertical direction. In this case, the first pixel data calculator 30 reads the first error value Err1 from the storage unit 41 for four pixels, namely, a pixel PX (n−1, m−1) adjacent to the pixel PX (n, m) in an upward/leftward direction, a pixel PX (n−1, m) adjacent to the pixel PX (n, m) in an upward direction, a pixel PX (n−1, m+1) adjacent to the pixel PX (n, m) in an upward/rightward direction, and a pixel PX (n, m−1) adjacent to the pixel PX (n, m) in a leftward direction. As shown by the following expression (3), the four read first error values Err1 are respectively multiplied by coefficients a through d, the obtained four products are added together, and the obtained sum is added with the input data vd_in (n, m). Thus, the first pixel data vd1_mod (n, m) is provided.

$$vd1_\mathrm{mod}(n,m)=a\times\mathrm{Err1}(n-1,m-1)+b\times\mathrm{Err1}(n-1,m)+c\times\mathrm{Err1}(n-1,m+1)+d\times\mathrm{Err1}(n,m-1)+vd_\mathrm{in}(n,m) \quad (3)$$

In the expression (3), constants a, b, c and d are normalization coefficients for the diffused error, and are predefined such that a+b+c+d=1. There are a plurality of methods for selecting specific values for a through d. For example, with the Floyd-Steinberg method, a=1/16, b=5/16, c=3/16 and d=7/16. With the Sierra's Filter Lite method, a=0, b=1/4, c=1/4 and d=1/2. Which method is to be adopted may be determined in consideration of, for example, the quality required of the image display device 1.

Figure 6B:
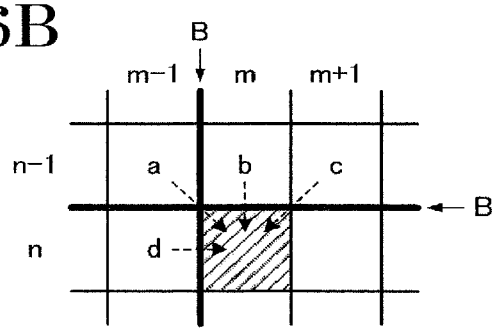

FIG. 6B shows the case where the pixel PX (n, m) is located in contact with both the border extending in the horizontal direction and the border extending in the vertical direction. As described above, the first pixel data calculator 30 limits the range of pixels, the first error value Err1 for which is to be referred to, to the "pixels belonging to the same error diffusion block BL as the pixel PX (n, m)". Therefore, in this case, the first pixel data calculator 30 calculates the first pixel data vd1_mod (n, m) with no reference to any of the four first error values Err1 referred to in the example of FIG. 6A. Specifically, as shown by the following expression (4), the first pixel data calculator 30 sets the input data vd_in (n, m) as the first input pixel data vd1_mod (n, m).

$$vd1_\mathrm{mod}(n,m)=vd_\mathrm{in}(n,m) \quad (4)$$

Figure 6C:
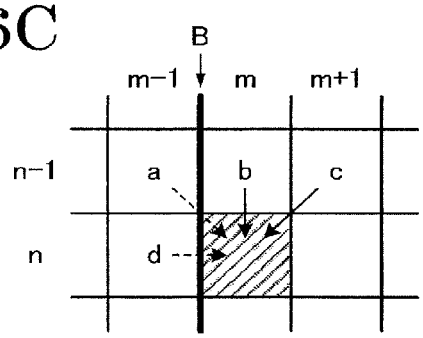

FIG. 6C shows the case where the pixel PX (n, m) is located in contact with only the border extending in the vertical direction. In this case, the first pixel data calculator 30 calculates the first pixel data vd1_mod (n, m) with no reference to any of the first error values Err1 ($n-1$, $m-1$) and Err1 ($n$, $m-1$), among the four first error values Err1 referred to in the example of FIG. 6A, that correspond to two pixels PX (n−1, m−1) and PX (n, m−1) not belonging to the same error diffusion block BL as the pixel PX (n, m). Specifically, as shown by the following expression (5), the first error values Err1 ($n-1$, $m$) and Err1 ($n-1$, $m+1$) corresponding to two pixels PX (n−1, m) and PX (n−1, m+1) belonging to the same error diffusion block BL as the pixel PX (n, m) are respectively multiplied by the coefficients b and c, the obtained products are added together, and the obtained result is added with the input data vd_in (n, m). Thus, the first pixel data vd1_mod (n, m) is provided.

$$vd1_\mathrm{mod}(n,m)=b\times\mathrm{Err1}(n-1,m)+c\times\mathrm{Err1}(n-1,m+1)+vd_\mathrm{in}(n,m) \quad (5)$$

Figure 6D:
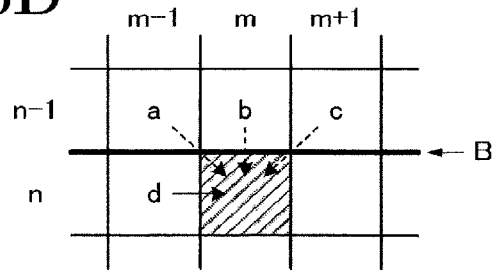

FIG. 6D shows the case where the pixel PX (n, m) is located in contact with only the border extending in the horizontal direction. In this case, the first pixel data calculator 30 calculates the first pixel data vd1_mod (n, m) with no reference to any of the first error values Err1 ($n-1$, $m-1$), Err1 ($n-1$, $m$) and Err1 ($n-1$, $m+1$), among the four first error values Err1 referred to in the example of FIG. 6A, that correspond to three pixels PX (n−1, m−1), PX (n−1, m) and PX (n−1, m+1) not belonging to the same error diffusion block BL as the pixel PX (n, m). Specifically, as shown by the following expression (6), the first error value Err1 ($n$, $m-1$) corresponding to the pixel PX (n, m−1) belonging to the same error diffusion block BL as the pixel PX (n, m) is multiplied by the coefficient d and the obtained product is added with the input data vd_in (n, m). Thus, the first pixel data vd1_mod (n, m) is provided.

$$vd1_\mathrm{mod}(n,m)=d\times\mathrm{Err1}(n,m-1)+vd_\mathrm{in}(n,m) \quad (6)$$

Returning to FIG. 4, after the first pixel data vd1_mod (n, m) is calculated in step S4, the second pixel data calculator 31 performs a process of calculating the second pixel data vd2_mod (n, m) (step S5). This will be described specifically. The second pixel data calculator 31 first reads the corrected error value Err2' from the storage unit 41 for four pixels, namely, the pixel PX (n−1, m−1) adjacent to the pixel PX (n, m) in the upward/leftward direction, the pixel PX (n−1, m) adjacent to the pixel PX (n, m) in the upward direction, the pixel PX (n−1, m+1) adjacent to the pixel PX (n, m) in the upward/rightward direction, and the pixel PX (n, m−1) adjacent to the pixel PX (n, m) in the leftward direction. As shown by the following expression (7), the four read corrected error values Err2' are respectively multiplied by the coefficients a through d, the obtained four products are added together, and the obtained sum is added with the input data vd_in (n, m). Thus, the second pixel data vd2_mod (n, m) is provided. Expression (7) is obtained by replacing the first error Err1 in expression (3) with the corrected error value Err2'.

$$vd2_\mathrm{mod}(n,m)=a\times\mathrm{Err2'}(n-1,m-1)+b\times\mathrm{Err2'}(n-1,m)+c\times\mathrm{Err2'}(n-1,m+1)+d\times\mathrm{Err2'}(n,m-1)vd_\mathrm{in}(n,m) \quad (7)$$

Next, the first quantized data calculator 32 calculates the first quantized data LV1 ($n$, $m$), and the first output pixel data calculator 33 calculates the first output pixel data vd1_out (n, m) (step S6: "process of calculating LV1 ($n$, $m$) and vd1_out (n, m)"). The second quantized data calculator 34 calculates the second quantized data LV2 ($n$, $m$), and the second output pixel data calculator 35 calculates the second output pixel data vd2_out (n, m) (step S7: "process of calculating LV2 ($n$, $m$) and vd2_out (n, m)").

Figure 7:
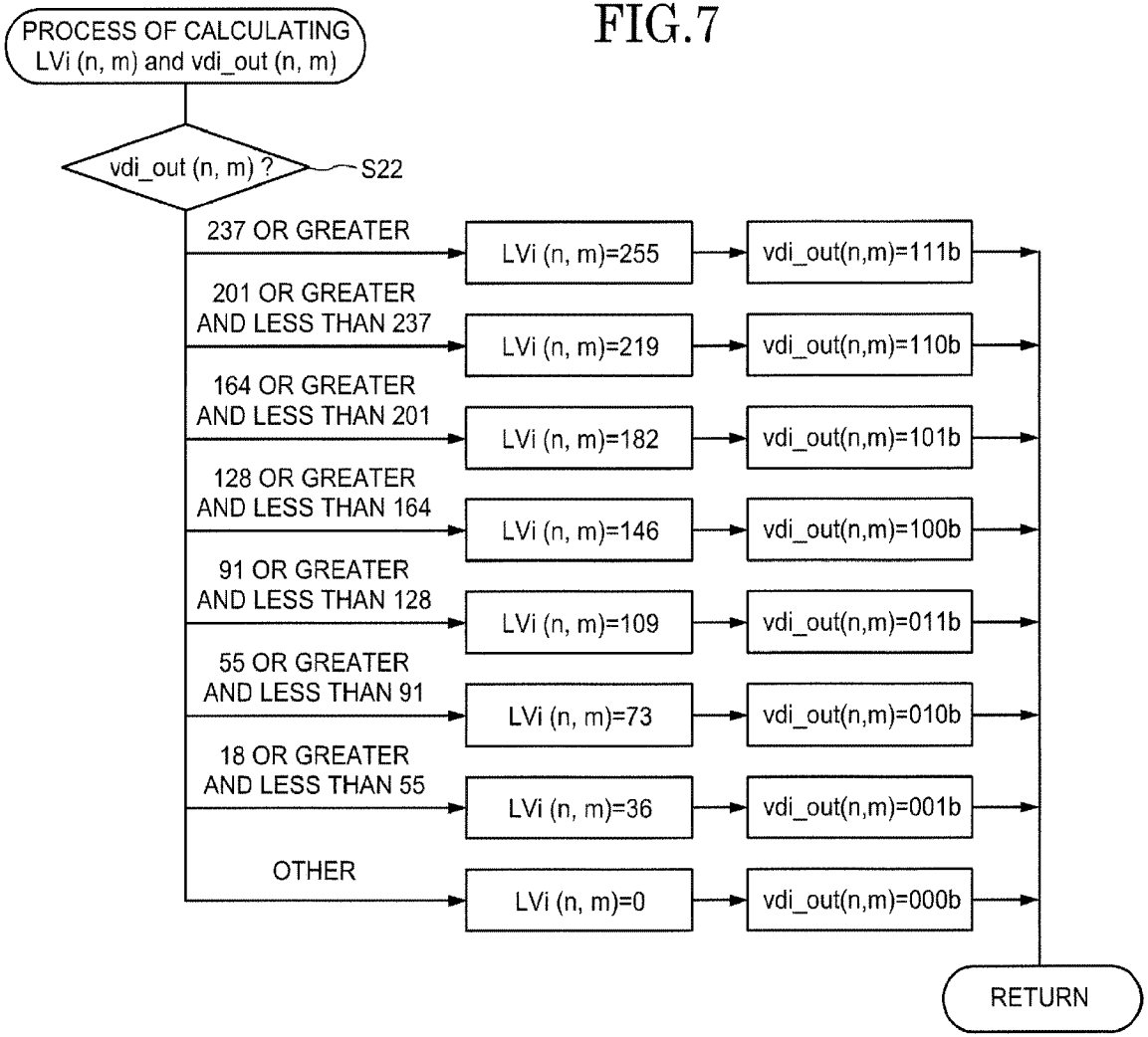
FIG. 7 is a flowchart showing the details of the process of calculating LV1 (*n, m*) and vd1_out (n, m) or the process of calculating LV2 (*n, m*) and vd2_out (n, m) shown in FIG. 4.

FIG. 7 is a flowchart showing the details of the process of calculating LV1 ($n$, $m$) and vd1_out (n, m), or the process of calculating LV2 ($n$, $m$) and vd2_out (n, m). In FIG. 7, "i" is a variant representing "1" or "2". In the following description, the process when i=1, namely, the process of calculating LV1 (*n, m*) and vd1_out (n, m) will be described. The process of calculating LV2 (*n, m*) and vd2_out (n, m) is substantially the same.

First, the first quantized data calculator 32 makes a determination on the range of the values of the first pixel data vd1_mod (n, m) (step S22). In the example of FIG. 7, the first quantized data calculator 32 determines which of the following ranges the value of the first pixel data vd1_mod (n, m) belongs to: "237 or greater", "201 or greater and less than 237", "164 or greater and less than 201", "128 or greater and less than 164", "91 or greater and less than 128", "55 or greater and less than 91", "18 or greater and less than 55", and "other (less than 18)". In the example of FIG. 7, these eight ranges are used as described above. This corresponds to eight types of numerical figures "0" through "7", which can be represented by three bits of the first output pixel data vd1_out (n, m). Depending on the number of bits of the first output pixel data vd1_out (n, m), the ranges may be set more finely or more roughly. As the ranges are set more finely, a more precise image is provided.

The first quantized data calculator 32 calculates the first quantized data LV1 (*n, m*) based on the determination result in step S22. In the example of FIG. 7, in the case where, for example, the value of the first pixel data vd1_mod (n, m) is "237 or greater", the first quantized data calculator 32 determines the value of the first quantized data LV1 (*n, m*) as "255". Similarly, the first quantized data calculator 32 determines the value of the first quantized data LV1 (*n, m*) as "219" for the range of "201 or greater and less than 237", as "182" for the range of "164 or greater and less than 201", as "146" for the range of "128 or greater and less than 164", as "109" for the range of "91 or greater and less than 128", as "73" for the range of "55 or greater and less than 91", "36" for the range of "18 or greater and less than 55", and as "0" for "other (range of less than 18)".

When the first quantized data LV1 (*n, m*) is thus determined, the first output pixel data calculator 33 calculates the value of the first output pixel data vd1_out (n, m), which is 3-bit data. This will be described specifically. In the case where, for example, the value of the first quantized data LV1 (*n, m*) is "255", the first output pixel data calculator 33 sets the value of the first output pixel data vd1_out (n, m) as "111b". Similarly, the first output pixel data calculator 33 sets the value of the first output pixel data vd1_out (n, m) as "110b" for "219", as "101 b" for "182", as "100b" for "146", as "011 b" for "109", as "010b" for "73", as "001 b" for "36", and as "000b" for "0".

Returning to FIG. 4, after the first quantum data LV1 (*n, m*), the first output pixel data vd1_out (n, m), the second quantum data LV2 (*n, m*) and the second output pixel data vd2_out (n, m) are calculated in steps S6 and S7, the second output pixel data vd2_out (n, m) is output as the output data vd_out (n, m) of the gray scale converter 10 (step S8). The output data vd_out (n, m) is supplied to the display 20 shown in FIG. 1, and is used to display (draw) an image on the display plane 21.

Next, the first error value calculator 36 calculates the first error value Err1 (*n, m*) and the second error value calculator 37 calculates the second error value Err2 (*n, m*) (steps S9 and S10). Specific methods for these processes are as shown in above-described expressions (1) and (2). As described above, the first error value Err1 (*n, m*) calculated by the first error value calculator 36 is stored on the storage unit 41 shown in FIG. 3 as the first error value Err1 corresponding to the pixel PX (n, m), and is used to calculate the first pixel data vd1_mod for the other pixels PX adjacent to the pixel PX (n, m) (specifically, four pixels PX of pixels PX (n, m+1), PX (n+1, m−1), PX (n+1, m) and PX (n+1, m+1)).

The first pixel data vd1_mod and the first quantized data LV1 usable to calculate the first error value Err1 are limited to within the same error diffusion block BL as the pixel PX (n, m) (namely, as described above with reference to FIG. 5, the first error value Err1 is calculated with no reference to the first error value corresponding to any pixel PX not belonging to the same error diffusion block BL as the pixel PX (n, m)). Therefore, the first error value Err1 is also limited to within the same error diffusion block BL as the pixel PX (n, m). By contrast, the second pixel data vd2_mod and the second quantized data LV2 usable to calculate the second error value Err2 are not limited to within the same error diffusion block BL as the pixel PX (n, m) (namely, as described above with reference to FIG. 5, the second error value Err2 is calculated with no consideration of the error diffusion block BL). Therefore, the second error value Err2 is not limited to within the same error diffusion block BL as the pixel PX (n, m), either.

In the final step, the limited error value calculator 38, the determination unit 39 and the corrected error value calculator 40 perform a process of calculating the corrected error value Err2' (*n, m*) (step S11: "process of calculating Err2' (*n, m*)".

Figure 8:
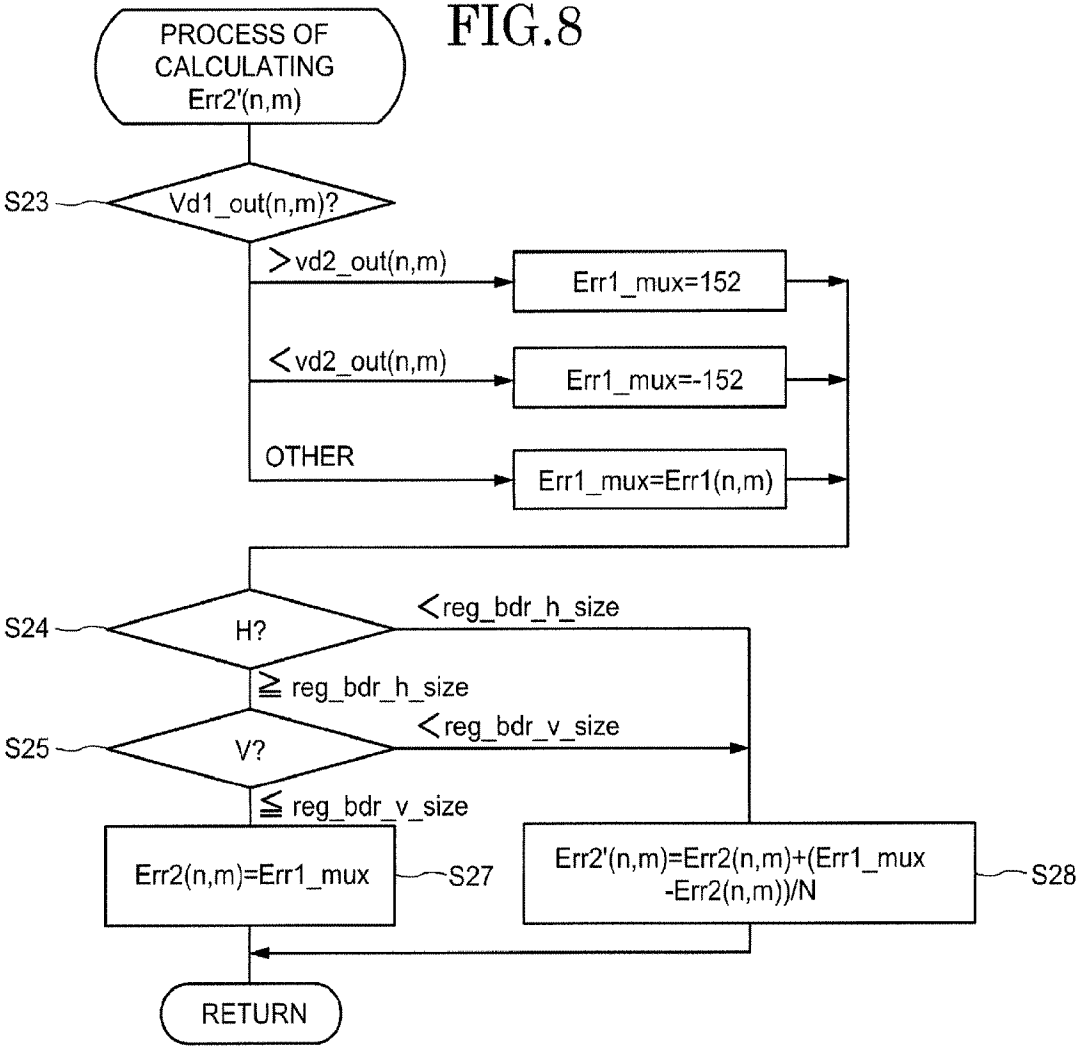
FIG. 8 is a flowchart showing the details of the process of calculating Err2' (*n, m*) shown in FIG. 4.

FIG. 8 is a flowchart showing the details of the process of calculating Err2' (*n, m*). In this process, first, the limited error value calculator 38 makes a determination on the relationship between the first output pixel data vd1_out (n, m) and the second output pixel data vd2_out (n, m) (step S23). Alternatively, in this process, the relationship between the first quantized data LV1_out (n, m) and the second quantized data LV2_out (n, m) may be determined.

In the case where the first output pixel data vd1_out (n, m) is larger than the second output pixel data vd2_out (n, m), the limited error value calculator 38 sets numerical value "152" as the limited error value Err1_mux. By contrast, in the case where the first output pixel data vd1_out (n, m) is smaller than the second output pixel data vd2_out (n, m), the limited error value calculator 38 sets numerical value "−152" as the limited error value Err1_mux. In the other case, namely, in the case where the first output pixel data vd1_out (n, m) is equal to the second output pixel data vd2_out (n, m), the limited error value calculator 38 sets the first error value Err1 (*n, m*) as the limited error value Err1_mux.

Next, the determination unit 39 makes a threshold value determination on the horizontal direction distance H and the vertical direction distance V shown in FIG. 2B. As shown in FIG. 2B, the horizontal direction distance H is a distance from the left end of the error diffusion block BL to which the pixel PX (n, m) belongs, to the pixel PX (n, m), and is represented by the number of pixels. Similarly, the vertical direction distance V is a distance from the top end of the error diffusion block BL to which the pixel PX (n, m) belongs, to the pixel PX (n, m), and is represented by the number of pixels. In, for example, FIG. 2B, the horizontal direction distance H and the vertical direction distance V regarding the pixel PX represented by hatching are each "5". In the above description, the horizontal direction distance H and the vertical direction distance V are respectively measured from the "left end" and the "top end". A reason for this is that the scanning direction of the image display device 1 (direction in which the input data vd_in (n, m) is supplied) is from left to right and from top to bottom. In the case where the scanning direction is different, the horizontal direction distance H and the vertical direction distance V are measured from different positions.

The determination unit 39 has, stored thereon, threshold value reg_bdr_h_size in advance as a threshold value for the horizontal direction distance H. The determination unit 39 also has, stored thereon, threshold value reg_bdr_v_size in advance as a threshold value for the vertical direction distance H. The determination unit 39 compares the threshold values against the horizontal direction distance H and the vertical direction distance V respectively to make the above-described threshold determination (steps S24 and S25).

In the case where it is determined by the determination unit 39 that the horizontal direction distance H is smaller than the threshold value reg_bdr_h_size or the vertical direction distance V is smaller than the threshold value reg_bdr_v_size, namely, in the case where the pixel PX (n, m) is located within a predetermined range from the left end or the top end of the error diffusion block BL, the corrected error value calculator 40 corrects the second error value Err2 (*n, m*) in a direction in which the second error value Err2 (*n, m*) approaches the first error value Err1 (*n, m*) to provided the corrected error value Err2' (*n, m*) for the pixel PX (n, m). Specifically, as shown in the following expression (8), a value based on a value obtained by subtracting the second error value Err2 (*n, m*) from the limited error value Err1_mux (more specifically, a value obtained by, first, subtracting the second error value Err2 (*n, m*) from the limited error value Err1_mux and then dividing the resultant value by predetermined value N) is subtracted from the second error value Err2 (*n, m*). Thus, the corrected error value Err2' (*n, m*) is provided (step S26). A specific value of the predetermined value is preferably "16".

$$Err2'(n, m) = Err2(n, m) + \frac{Err1_\text{mux} - Err2(n, m)}{N} \tag{8}$$

Instead of the predetermined value N, a function of the number of pixels from the border of the error diffusion block may be used.

By contrast, in the case where it is determined by the determination unit 39 that the horizontal direction distance H is larger than, or equal to, the threshold value reg_bdr_h_size and the vertical distance V is larger than, or equal to, the threshold value reg_bdr_v_size, namely, in the case where the pixel PX (n, m) is not located within the predetermined range from the left end or the top end of the error diffusion block BL, the corrected error value calculator 40 sets the limited error value Err1_mul as the corrected error value Err2' (*n, m*) as shown in the following expression (9) (step S27).

$$\text{Err2}'(n,m)=\text{Err1}_mux \tag{9}$$

As described above, the corrected error value Err2' (*n, m*) calculated by the corrected error value calculator 40 is stored on the storage unit 41 shown in FIG. 3 as the corrected error value Err2' corresponding to the pixel PX (n, m), and is used to calculate the second pixel data vd2_mod for the other pixels PX adjacent to the pixel PX (specifically, four pixels PX of the pixels PX (n, m+1), PX (n+1, m−1), PX (n+1, m) and PX (n+1, m+1)).

Returning to FIG. 4, the processes for one piece of input data vd_in (n, m) are thus finished. When all the processes for one piece of input data vd_in (n, m) are finished, the processes for one frame performed by the error diffusion processor 11 are finished. Then, the processes for the next frame are performed in substantially the same manner although not shown.

As described above, the image display device 1 in this embodiment generates the output data vd_out (n, m) from the second pixel data dv2_mod (n, m), which is calculated based on the corrected error value Err2'. The corrected error value Err2', which is calculated by the corrected error value calculator 40 by the above-described process, is continuously changed even when crossing the border B as shown in FIG. 9. Thus, with the image display device 1 in this embodiment, the border between the error diffusion blocks BL, which is conspicuous by the technology described in Patent Literature 1, is suppressed from being conspicuous.

A preferable embodiment according to the present invention has been described. The present invention is not limited to the above-described embodiment in any way, and may be carried out in any of various forms without departing from the gist of the present invention, needless to say.

For example, in the above-described embodiment, the display 20 provides monochrome display. As described above, the present invention is applicable to the case where the display 20 provides color display. In such a case, the gray scale converter 10 is supplied with the input data vd_in (n, m) for each of colors (e.g., red (R), green (G), blue (B) and white (W)). Thus, the above-described processes are performed on each of the colors.

Figure 10:
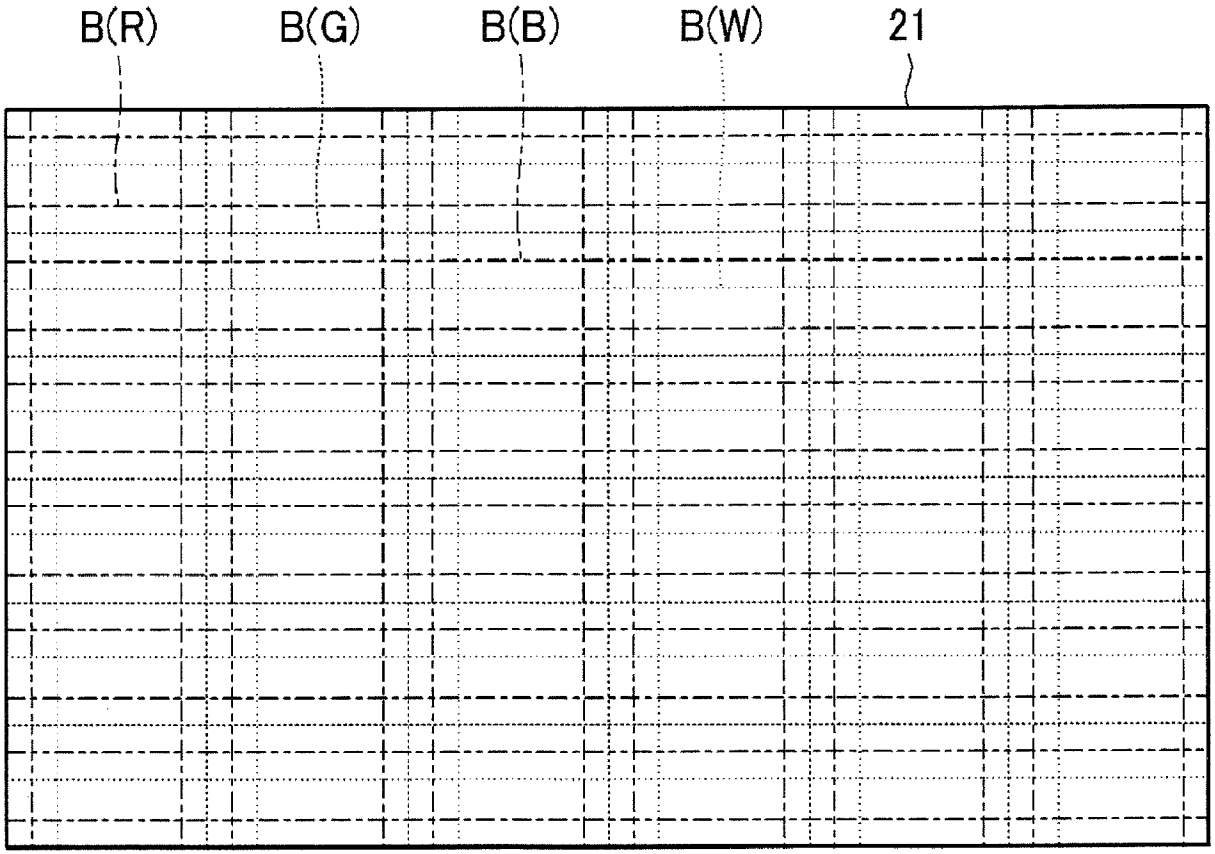
FIG. 10 shows error diffusion blocks BL provided at the display plane 21 in a first modification of the above-described embodiment according to the present invention.

In the case where the display 20 providing color display is used, the error diffusion blocks BL are located in the same manner for all the colors, or may be located differently by color. FIG. 10 shows an example of the error diffusion blocks BL in the latter case (first modification). In FIG. 10, borders B(R), B(G), B(B) and B(W) are respectively borders of the error diffusion blocks BL corresponding to red (R), green (G), blue (B) and white (W). In this example, the error diffusion blocks BL each have a shape that is basically the same as that of the example shown in FIG. 2A and FIG. 2B, but are located in an offset manner in accordance with the color. In this manner, the error diffusion blocks BL may be located differently by color. The error diffusion blocks BL may be located appropriately so as to provide an optimum display result.

Figure 11:
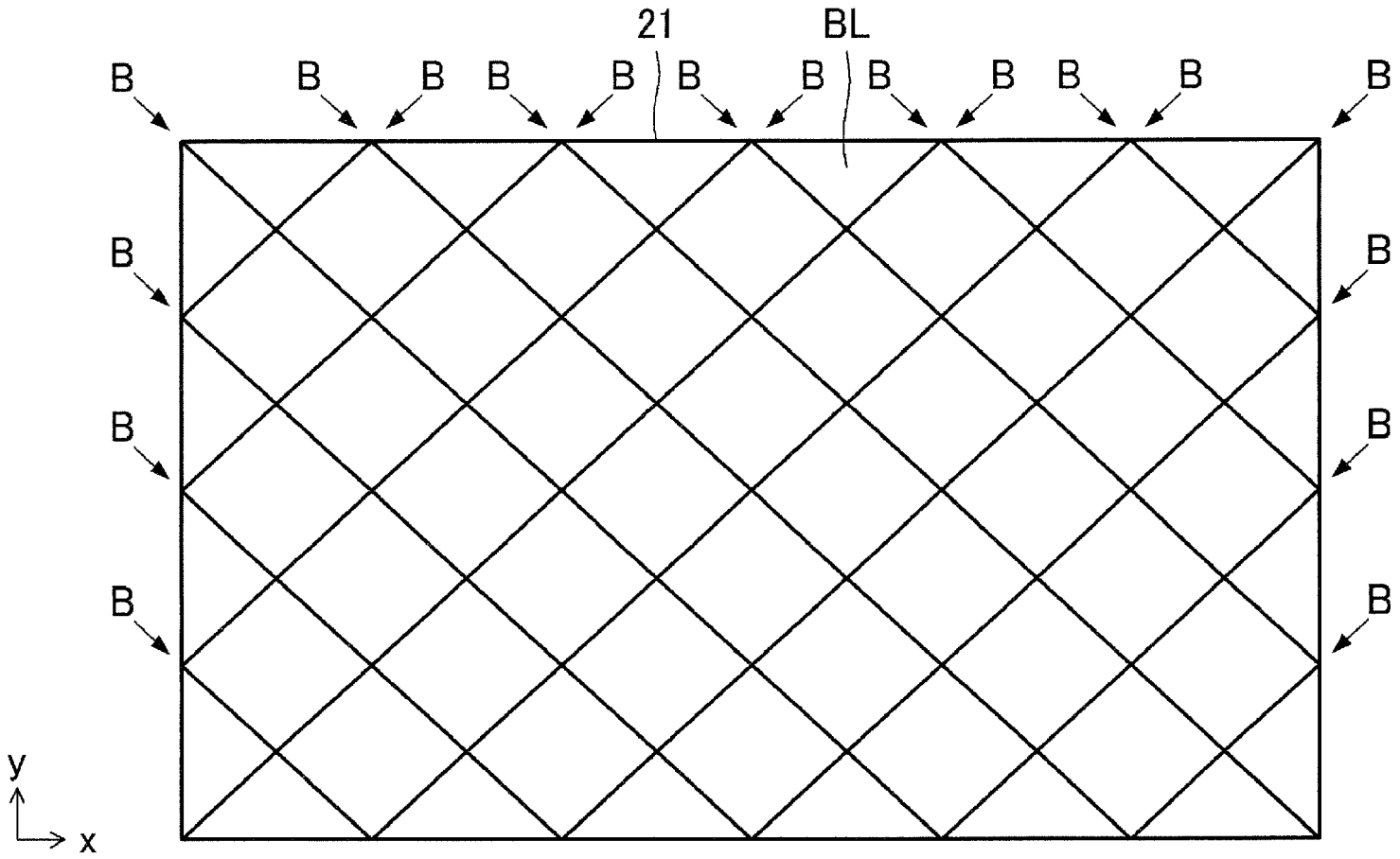
FIG. 11 shows error diffusion blocks BL provided at the display plane 21 in a second modification of the above-described embodiment according to the present invention.

In the above-described embodiment, each of the error diffusion blocks BL has a rectangular shape defined by two sides parallel to each other and extending in the horizontal direction and two sides parallel to each other and extending in the vertical direction. The error diffusion blocks BL may each have a different shape. FIG. 11 shows an example in which each of the error diffusion blocks BL has a parallelogrammatic shape defined by four sides inclined with respect to the horizontal direction and the vertical direction (second modification). As can be seen, there is no limitation on the shape of each of the error diffusion blocks BL, and each of the error diffusion blocks BL may have an appropriate shape so as to provide an optimum result.

The input data vd_in (n, m) to be input to the error diffusion processor 11 in the above-described embodiment may have been dithered by a dithering processor (not shown) included in the gray scale converter 10. For example, 8-bit image data may be converted into 6-bit image data by the dithering processor by dithering 8, and the 6-bit image data may be converted into 4-bit image data by dithering 6. The 4-bit image data may be input to the error diffusion processor 11 as the input data vd_in.

The effect of the embodiment according to the present invention is especially useful in the case where a moving image is embedded in a part of the image whereas the remaining part of the image is still. In other words, the effect of the embodiment according to the present invention is not very useful in the case where the image is entirely moving or still. Therefore, before the error diffusion processor 11 performs the processes, it may be determined whether or not the input data vd_in to be displayed represents an image having a moving image embedded in a part thereof and having a still image in the remaining part thereof. In accordance with the determination result, the type of processes to be performed may be changed. Specifically, in the case where the determination result is positive, the processes described in the above-described embodiment may be performed. By contrast, in the case where the determination result is negative, for example, the first pixel data vd1_mod (n, m) calculated in step S4 in FIG. 4 may be output as the output data vd_out (n, m) and the processes in steps S5, S7, S8, S10 and S11 may be skipped.

Figure 12:
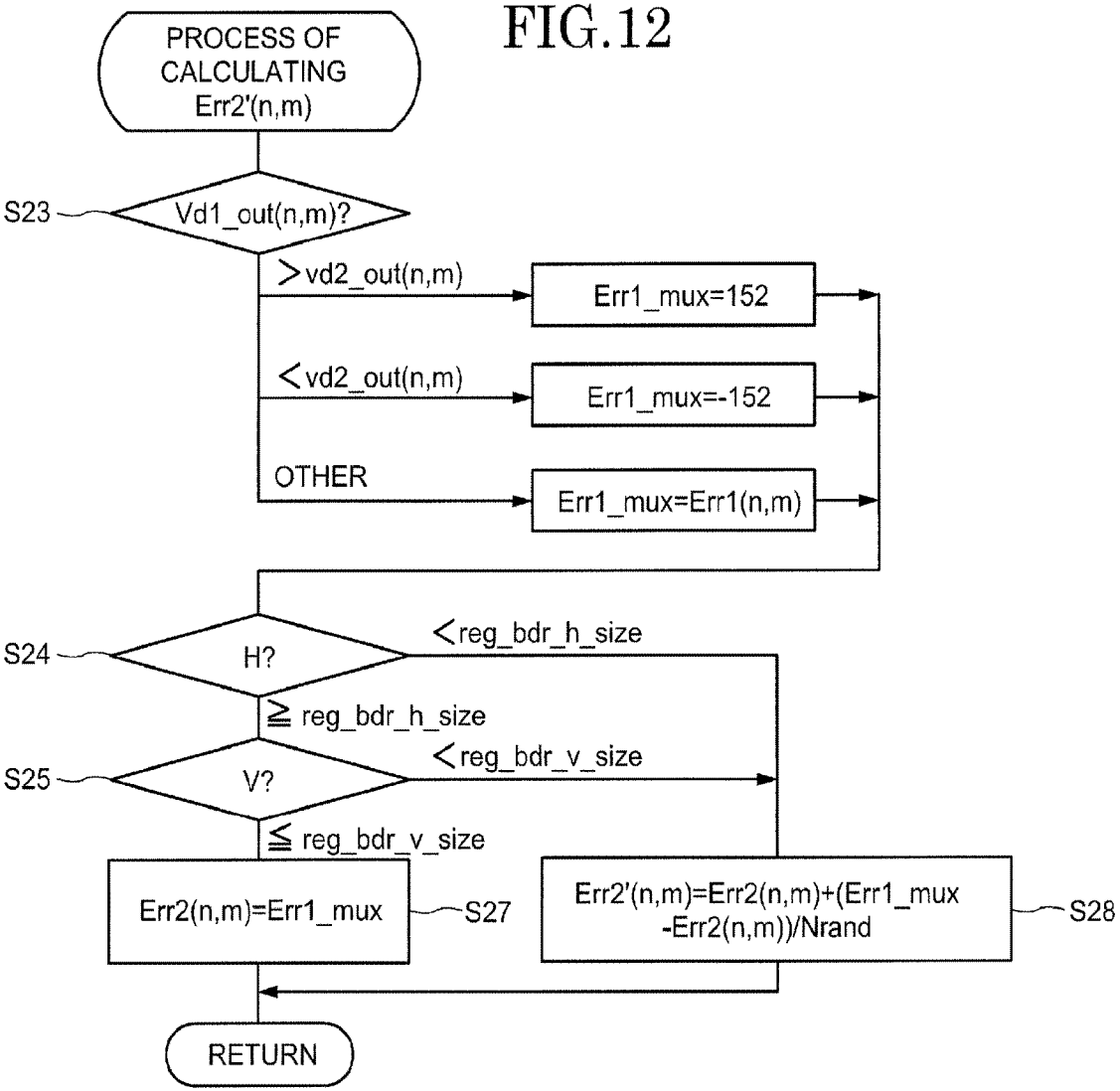
FIG. 12 is a flowchart showing the details of another embodiment of the process of calculating Err2' (*n, m*) shown in FIG. 4.

FIG. 12 is a flowchart showing the details of another embodiment of the process of calculating Err2' (*n, m*) shown in FIG. 8. The steps same as those in FIG. 8 will not be described.

In the case where it is determined by the determination unit 39 that the horizontal direction distance H is smaller than the threshold value reg_bdr_h_size or the vertical direction distance V is smaller than the threshold value reg_bdr_v_size, namely, in the case where the pixel PX (n, m) is located within a predetermined range from the left end or the top end of the error diffusion block BL, the corrected error value calculator 40 corrects the second error value Err2 (*n, m*) in a direction in which the second error value Err2 (*n, m*) approaches the first error value Err1 (*n, m*) to provide the corrected error value Err2' (*n, m*) for the pixel PX (n, m). Specifically, as shown in the following expression (10), a value based on a value obtained by subtracting the second error value Err2 (*n, m*) from the limited error value Err1_mux (more specifically, a value obtained by, first, subtracting the second error value Err2 (*n, m*) from the limited error value Err1_mux and then dividing the resultant value by a second predetermined value Nrand) is subtracted from the second error value Err2 (*n, m*) to provide the corrected error value Err2' (*n, m*) (step S29).

$$Err2'(n, m) = Err2(n, m) + \frac{Err1_mux - Err2(n, m)}{N_{rand}} \tag{10}$$

The second predetermined value Nrand may be a random number. The random number may be generated, by a random number generator included in an error diffusion processor in an embodiment according to the present invention, in accordance with at least one of the determination result of the determination unit 39, the output of the limited error value calculator 38, and the output of the second error value calculator 37.

Figure 13A:
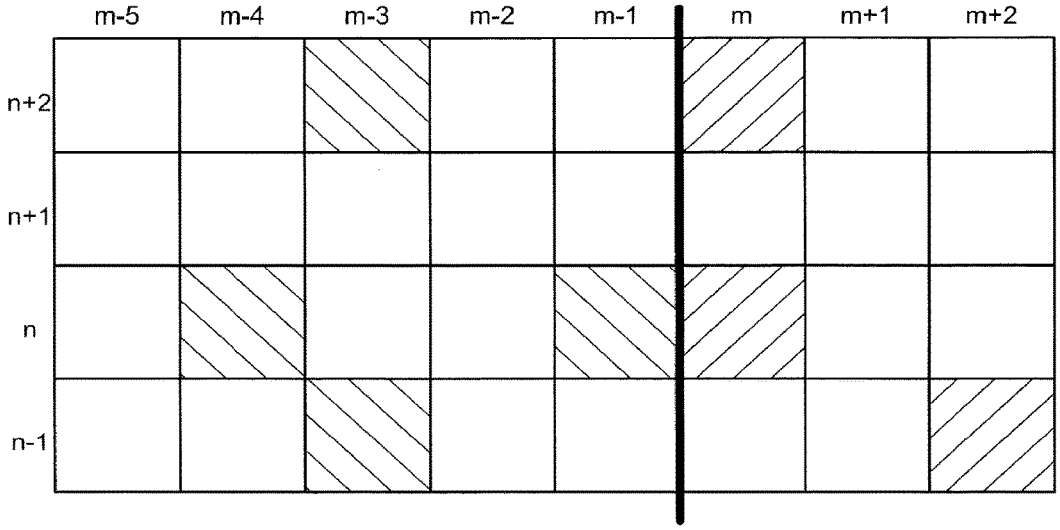
FIG. 13A and FIG. 13B show a third modification of the above-described embodiment according to the present invention.
Figure 13B:
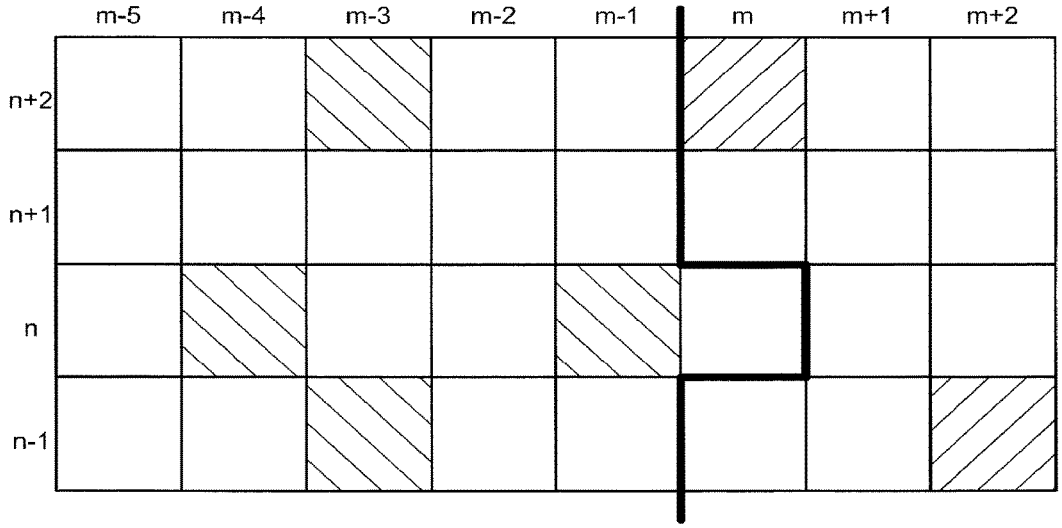

FIG. 13A and FIG. 13B show a third modification of the embodiment according to the present invention.

In FIG. 13A, the pixel PX (n, m) and the pixel PX (n, m−1) are located adjacent to each other while having a border extending in the vertical direction therebetween. Regarding the pixel PX (n, m), the range of pixels, the first error value Err1 for which is to be referred to, is limited to the "pixels belonging to the same error diffusion block BL as the pixel PX (n, m)". Regarding the pixel PX (n, m−1), the range of pixels, the corrected error value Err2' for which is to be referred to, is not limited to the "pixels belonging to the same error diffusion block BL as the pixel PX (n, m)". In this case, the border between the error diffusion blocks BL may be conspicuous.

In FIG. 13B, the error diffusion blocks BL are shaped such that the border referred to in FIG. 13A protrudes in a perpendicular direction by one pixel. In the case where the pixel, the first error value Err1 for which is to be referred to, and the pixel, the corrected error value Err2' for which is to be referred to, are adjacent to each other as in this case, the shape of the error diffusion blocks BL, namely, the shape of the border, may be changed such that neither of the pixels is in contact with the border between the error diffusion blocks BL. In this manner, the border between the error diffusion blocks BL is made inconspicuous. There is no limitation on the shape of each of the error diffusion blocks BL, and the shape may be selected so as to provide an optimum result.

Figure 14:
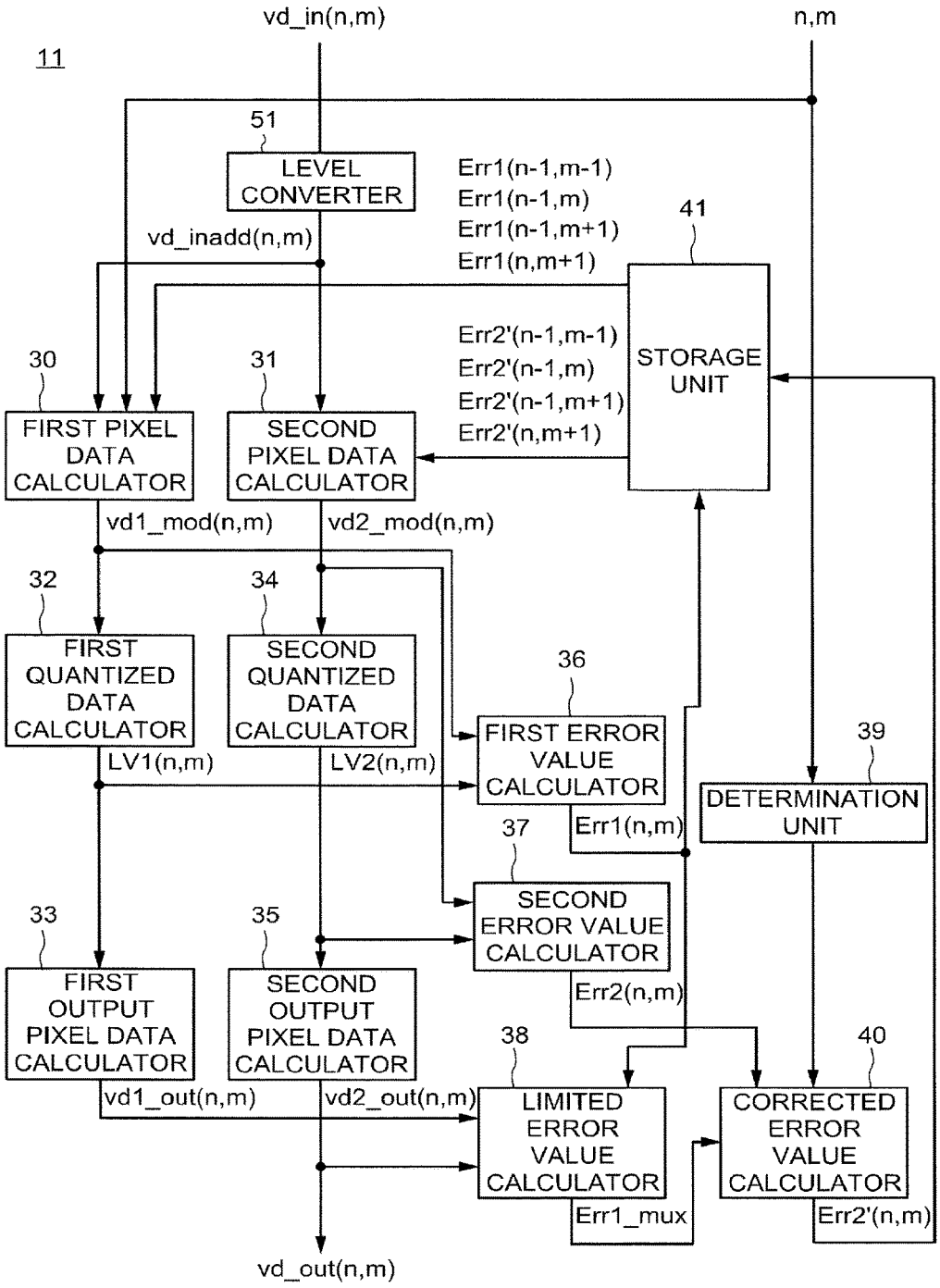
FIG. 14 is a schematic block diagram showing another embodiment of the functional blocks of the error diffusion processor 11 shown in FIG. 3.

FIG. 14 is a schematic block diagram showing another embodiment of the functional blocks of the error diffusion processor 11 shown in FIG. 3. The elements described above will not be described in repetition.

In the embodiment shown in FIG. 14, the diffusion processor 11 includes a level converter 51 in addition to the elements shown in FIG. 3. The level converter 51 converts the level of the input data vd_in (n, m) and outputs the level-converted data vd_inadd (n, m). The "level" refers to the gray scale level. In the case of 8-bit input data, the gray scale level thereof is one of 256 levels from level 0 to level 255.

FIG. 15A through FIG. 15C show specific examples in the embodiment shown in FIG. 14. In FIG. 15A through FIG. 15C, each of squares represents a pixel PX. The numerical figure in each square is an 8-bit decimal number representing the input data vd_in (n, m) for each pixel. The level converter 51 handles a pixel group including 2×2 pixels PX located in a two-dimensional matrix as shown in FIG. 15A as one unit. For the upper left pixel and the lower right pixel, the level converter 51 decreases the level of the input data vd_in (n, m) by 2. For the upper right pixel and the lower left pixel, the level converter 51 increases the level of the input data vd_in (n, m) by 2.

This will be described more specifically. FIG. 15B shows 4×4 pixels PX located in a two-dimensional matrix and the input data vd_in (n, m) for each of the pixels. FIG. 15C shows the 4×4 pixels PX shown in FIG. 15B. The input data vd_in (n, m) for each of the pixels in FIG. 15B is input to the level converter 51 and level-converted. FIG. 15C shows the level-converted data vd_inadd (n, m) obtained as a result of such level conversion. For example, for the pixel PX (n+1, m−1), the input data vd_in (n+1, m−1) has level 12. The post-level conversion data vd_inadd (n+1, m−1) has level 10. It is seen that the level has been changed. In this manner, the level converter 51 is provided in the error diffusion processor 11. The level converter 51 increases or decreases the level of the input data vd_in (n, m) shown in FIG. 15A to provide the data vd_inadd (n, m). This new input data (level-converted data) is used to calculate the first pixel data and the second pixel data. Such a gray scale process performed by use of the error diffusion method suppresses the border between the error diffusion blocks BL from being conspicuous. The embodiment described above with reference to FIG. 14 may be performed by replacing vd_in (n, m) in expressions (3) through (7) with vd_inadd (n, m).

Figure 16:
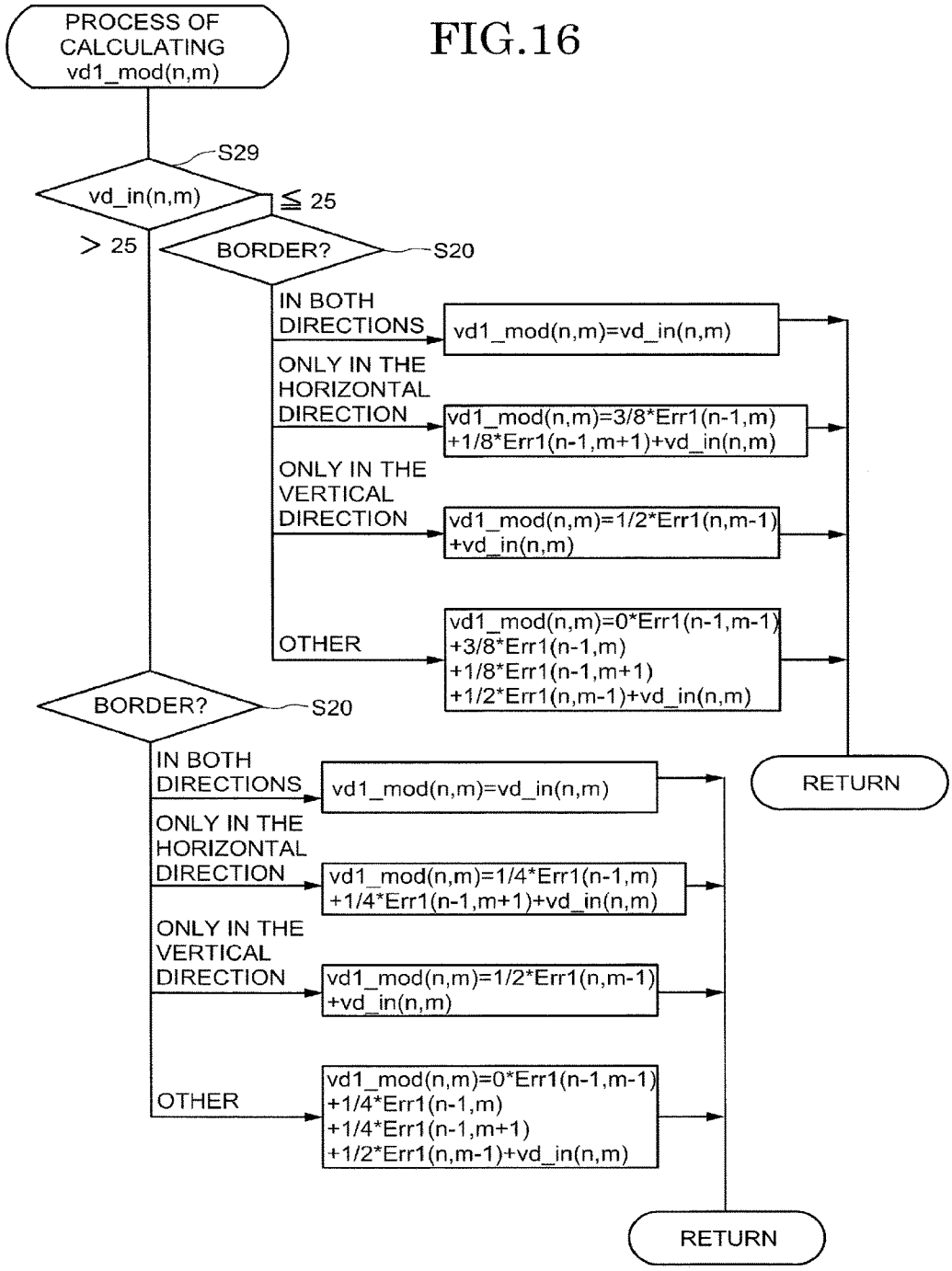
FIG. 16 is a flowchart showing the details of another embodiment of the process of calculating vd1_mod (n, m) shown in FIG. 5.

FIG. 16 is a flowchart showing the details of another embodiment of the process of calculating vd1_mod (n, m) shown in FIG. 5. The steps same as those in FIG. 5 and FIG. 6A through FIG. 6D will not be described.

In the case where the level of the input data vd_in (n, m) is level 25 or higher, the constants a, b, c and d showing the normalization coefficients for the diffused error described above are as follows: a is 0, b is ⅜, c is ⅛, and d is ½. As in the embodiment shown in FIG. 14, the level converter 51 may be included. The level of the input data vd_in (n, m) may be converted, and the level-converted data vd_inadd (n, m) may be output.

In the case where the pixel PX (n, m) is not located in contact with the border of the error diffusion block BL extending in the horizontal direction or the border of the error diffusion block BL extending in the vertical direction, vd1_mod (n, m) is represented by the following expression (11)

$$vd1_\mathrm{mod}(n,m)=\tfrac{3}{8}\mathrm{Err1}(n-1,m)+\tfrac{1}{8}\mathrm{Err1}(n-1,m+1)+\tfrac{1}{2}\mathrm{Err1}(n,m-1)+vd_\mathrm{in}(n,m) \quad (11)$$

In the case where the pixel PX (n, m) is located in contact with both of the border of the error diffusion block BL extending in the horizontal direction and the border of the error diffusion block BL extending in the vertical direction, vd1_mod (n, m) is represented by expression (4) described above.

In the case where the pixel PX (n, m) is located in contact with only the border of the error diffusion block BL extending in the vertical direction, vd1_mod (n, m) is represented by the following expression (12).

$$vd1_\mathrm{mod}(n,m)=\tfrac{3}{8}\mathrm{Err1}(n-1,m)+\tfrac{1}{8}\mathrm{Err1}(n-1,m+1)+vd_\mathrm{in}(n,m) \quad (12)$$

In the case where the pixel PX (n, m) is located in contact with only the border of the error diffusion block BL extending in the horizontal direction, vd1_mod (n, m) is represented by the following expression (13).

$$vd1_\mathrm{mod}(n,m)=\tfrac{1}{2}\mathrm{Err1}(n,m-1)+vd_\mathrm{in}(n,m) \quad (13)$$

By contrast, in the case where the level of the input data vd_in (n, m) is lower than level 25, the constants a, b, c and d showing the normalization coefficients for the diffused error described above are as follows: a is 0, b is ¼, c is ¼, and d is ½.

In the case where the pixel PX (n, m) is not located in contact with the border of the error diffusion blocks BL extending in the horizontal direction or the border of the error diffusion blocks BL extending in the vertical direction, vd1_mod (n, m) is represented by the following expression (14)

$$vd1_\mathrm{mod}(n,m)=\tfrac{1}{4}\mathrm{Err1}(n-1,m)+\tfrac{1}{4}\mathrm{Err1}(n-1,m+1)+\tfrac{1}{2}\mathrm{Err1}(n,m-1)+vd_\mathrm{in}(n,m) \quad (14)$$

In the case where the pixel PX (n, m) is located in contact with both of the border of the error diffusion blocks BL extending in the horizontal direction and the border of the error diffusion blocks BL extending in the vertical direction, vd1_mod (n, m) is represented by expression (4) described above.

In the case where the pixel PX (n, m) is located in contact with only the border of the error diffusion blocks BL extending in the vertical direction, vd1_mod (n, m) is represented by the following expression (15).

$$vd1_\mathrm{mod}(n,m)=\tfrac{1}{4}\mathrm{Err1}(n-1,m)+\tfrac{1}{4}\mathrm{Err1}(n-1,m+1)+vd_\mathrm{in}(n,m) \quad (15)$$

In the case where the pixel PX (n, m) is located in contact with only the border of the error diffusion blocks BL extending in the horizontal direction, vd1_mod (n, m) is represented by the following expression (16).

$$vd1_\mathrm{mod}(n,m)=\tfrac{1}{2}\mathrm{Err1}(n,m-1)+vd_\mathrm{in}(n,m) \quad (16)$$

In the case where the process of calculating vd1_mod (n, m) is performed along with the flowchart shown in FIG. 16, vd2_mod (n, m) is represented by expression (7). In the case where the level of the input data vd_in (n, m) is level 25 or higher, the constants a, b, c and d showing the normalization coefficients for the diffused error described above are as follows: a is 0, b is ⅜, c is ⅛, and d is ½. vd2_mod (n, m) is represented by expression (17).

$$vd2_\mathrm{mod}(n,m)=\tfrac{3}{8}\mathrm{Err2}'(n-1,m)+\tfrac{1}{8}\mathrm{Err2}'(n-1,m+1)+\tfrac{1}{2}\mathrm{Err2}'(n,m-1)+vd_\mathrm{in}(n,m) \quad (17)$$

In the case where the process of calculating vd1_mod (n, m) is performed along with the flowchart shown in FIG. 16, vd2_mod (n, m) is represented by expression (7). In the case where the level of the input data vd_in (n, m) is lower than level 25, the constants a, b, c and d showing the normalization coefficients for the diffused error described above are as follows: a is 0, b is ¼, c is ¼, and d is ½. vd2_mod (n, m) is represented by expression (18).

$$vd2_\mathrm{mod}(n,m)=\tfrac{1}{4}\mathrm{Err2}'(n-1,m)+\tfrac{1}{4}\mathrm{Err2}'(n-1,m+1)+\tfrac{1}{2}\mathrm{Err2}'(n,m-1)+vd_\mathrm{in}(n,m) \quad (18)$$

Figure 17A:
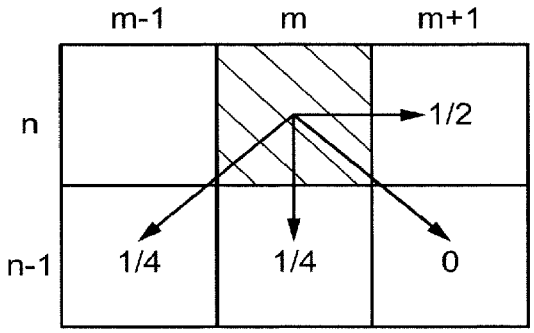
FIG. 17A and FIG. 17B show specific examples of another embodiment shown in FIG. 16 of the process of calculating vd1_mod (n, m).
Figure 17B:
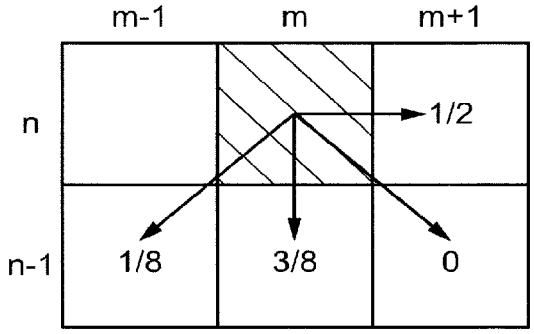

FIG. 17A and FIG. 17B each show a specific example of the process of calculating vd1_mod (n, m) in the embodiment shown in FIG. 16. As shown in FIG. 17A and FIG. 17B, in the processes of calculating vd1_mol (n, m) and vd2_mod (n, m), the constants a, b, c and d showing the normalization coefficients for the diffused error are changed in accordance with whether the level of the input data vd_in (n, m) is level 25 or higher, or is lower than level 25 to provide the level-converted data vd_inadd (n, m). Such a gray scale process performed by use of the error diffusion method suppresses the border between the error diffusion blocks BL from being conspicuous.

The above-described embodiments and modifications according to the present invention may be appropriately combined as long as no contradiction occurs. Devices described above in embodiments according to the present invention may have an element added thereto, or deleted therefrom, or may be changed in design optionally by a person of ordinary skill in the art. Methods described above in embodiments according to the present invention may have a step added thereto, or deleted therefrom, or may be changed in a condition optionally by a person of ordinary skill in the art. Such devices and methods are encompassed in the scope of the present invention as long as including the gist of the present invention.

Even functions and effects that are different from those provided by the above-described embodiments but are obvious from the description of this specification or are easily expectable by a person of ordinary skill in the art are naturally construed as being provided by the present invention.

The invention claimed is:

1. An image display device, comprising:

a display plane including a plurality of pixels located in a matrix, the display plane being divided into a plurality of error diffusion blocks;

a storage unit having, stored on the storage unit, a first error value and a corrected error value for each of the pixels;

a first pixel data calculator calculating first pixel data based on input data corresponding to a pixel of attention, among the plurality of pixels, and the first error value stored on the storage unit for each of pixels, among a predetermined number of pixels adjacent to the pixel of attention in a predetermined direction, belonging to the same error diffusion block as the pixel of attention;

a second pixel data calculator calculating second pixel data based on the input data corresponding to the pixel of attention and the corrected error value stored on the storage unit for each of the predetermined number of pixels adjacent to the pixel of attention in the predetermined direction;

a first quantized data calculator calculating first quantized data as a result of quantization of the first pixel data;

a second quantized data calculator calculating second quantized data as a result of quantization of the second pixel data;

a first error value calculator calculating the first error value based on a difference between the first pixel data and the first quantized data;

a second error value calculator calculating a second error value based on a difference between the second pixel data and the second quantized data;

a determination unit determining whether the pixel of attention is located within a predetermined range from a border among the plurality of error diffusion blocks;

a corrected error value calculator calculating the corrected error value for the pixel of attention by correcting the second error value in a direction in which the second error value approaches the first error value, in accordance with a determination result provided by the determination unit; and a limited error value calculator calculating a limited error value as a result of limiting the first error value in accordance with values of the first and second quantized data, wherein:

in the case where the determination result provided by the determination unit shows that the pixel of attention is located within the predetermined range from the border among the plurality of error diffusion blocks, the corrected error value calculator corrects the second error value in the direction in which the second error value approaches the first error value, to provide the corrected error value; and in the case where the determination result provided by the determination unit shows that the pixel of attention is not located within the predetermined range from the border among the plurality of error diffusion blocks, the corrected error value calculator sets the limited error value as the corrected error value for the pixel of attention.

2. The image display device according to claim 1, wherein the correction of the second error value in the direction in which the second error value approaches the first error value is performed by subtracting, from the second error value, a value based on a value obtained as a result of subtracting the second error value from the limited error value.

3. The image display device according to claim 2, wherein the value based on the value obtained as a result of subtracting the second error value from the limited error value is a value obtained as a result of dividing, by a predetermined value, the value obtained as a result of subtracting the second error value from the limited error value.

4. A method for driving an image display device including a display plane including a plurality of pixels located in a matrix, the display plane being divided into a plurality of error diffusion blocks; the method comprising:

storing a first error value and a corrected error value for each of the pixels on a storage unit;

calculating first pixel data based on input data corresponding to a pixel of attention, among the plurality of pixels, and the first error value stored on the storage unit for each of pixels, among a predetermined number of pixels adjacent to the pixel of attention in a predetermined direction, belonging to the same error diffusion block as the pixel of attention;

calculating second pixel data based on the input data corresponding to the pixel of attention and the corrected error value stored on the storage unit for each of the predetermined number of pixels adjacent to the pixel of attention in the predetermined direction;

calculating first quantized data as a result of quantization of the first pixel data;

calculating second quantized data as a result of quantization of the second pixel data;

calculating the first error value based on a difference between the first pixel data and the first quantized data;

calculating a second error value based on a difference between the second pixel data and the second quantized data;

determining whether the pixel of attention is located within a predetermined range from a border among the plurality of error diffusion blocks;

calculating the corrected error value for the pixel of attention by correcting the second error value in a direction in which the second error value approaches the first error value, in accordance with a result of the determination; and calculating a limited error value as a result of limiting the first error value in accordance with values of the first and second quantized data; wherein:

in the case where the result of the determination shows that the pixel of attention is located within the predetermined range from the border among the plurality of error diffusion blocks, the corrected error value is calculated by correcting the second error value in the direction in which the second error value approaches the first error value; and in the case where the result of the determination shows that the pixel of attention is not located within the predetermined range from the border among the plurality of error diffusion blocks, the limited error value is set as the corrected error value for the pixel of attention.

5. The method for driving an image display device according to claim 4, wherein the correction of the second error value in the direction in which the second error value approaches the first error value is performed by subtracting, from the second error value, a value based on a value obtained as a result of subtracting the second error value from the limited error value.

6. The method for driving an image display device according to claim 5, wherein the value based on the value obtained as a result of subtracting the second error value from the limited error value is a value obtained as a result of dividing, by a predetermined value, the value obtained as a result of subtracting the second error value from the limited error value.

7. An image display device, comprising:

a display plane including a plurality of pixels located in a matrix; and an error diffusion processor, wherein the display plane is divided into a plurality of error diffusion blocks, the error diffusion processor includes a storage unit having, stored on the storage unit, a first error value and a corrected error value for each of the pixels;

a first pixel data calculator receiving input data corresponding to a pixel of attention, among the plurality of pixels and the first error value stored on the storage unit for each of pixels, among n (n is an integer of 1 to N) number of pixels adjacent to the pixel of attention in a first direction, belonging to the same error diffusion block as the pixel of attention, calculating first pixel data using the input data corresponding to the pixel of attention and the first error value, and outputting the first pixel data;

a second pixel data calculator receiving the input data corresponding to the pixel of attention and the corrected error value stored on the storage unit for each of the n number of pixels adjacent to the pixel of attention in the first direction, calculating second pixel data using the input data corresponding to the pixel of attention and the corrected error value, and outputting the second pixel data;

a first quantized data calculator receiving the first pixel data from the first pixel data calculator, calculating first quantized data as a result of quantization of the first pixel data, and outputting the first quantized data;

a second quantized data calculator receiving the second pixel data from the second pixel data calculator, calculating second quantized data as a result of quantization of the second pixel data, and outputting the second quantized data;

a first error value calculator receiving the first pixel data from the first pixel data calculator and the first quantized data from the first quantized data calculator, calculating the first error value using a difference between the first pixel data and the first quantized data, and outputting the first error value;

a second error value calculator receiving the second pixel data from the second pixel data calculator and the second quantized data from the second quantized data calculator, calculating a second error value using a difference between the second pixel data and the second quantized data, and outputting the second error value;

a determination unit determining whether the pixel of attention is located within a predetermined range from a border among the plurality of error diffusion blocks;

a corrected error value calculator receiving a determination result provided by the determination unit and the second error value from the second error value calculator, calculating the corrected error value for the pixel of attention by correcting the second error value in a direction in which the second error value approaches the first error value, in accordance with the determination result provided by the determination unit and the second error value, and outputting the corrected error value to the storage unit; and a limited error value calculator receiving values based on the first and second quantized data and calculating a limited error value as a result of limiting the first error value in accordance with values of the first and second quantized data, in the case where the determination result provided by the determination unit shows that the pixel of attention is located within the predetermined range from the border among the plurality of error diffusion blocks, the corrected error value calculator corrects the second error value in the direction in which the second error value approaches the first error value, to provide the corrected error value, and in the case where the determination result provided by the determination unit shows that the pixel of attention is not located within the predetermined range from the border among the plurality of error diffusion blocks, the corrected error value calculator sets the limited error value as the corrected error value for the pixel of attention.

8. The image display device according to claim 7, wherein the correction of the second error value in the direction in which the second error value approaches the first error value is performed by subtracting, from the second error value, a value based on a value obtained as a result of subtracting the second error value from the limited error value.

9. The image display device according to claim 8, wherein the value based on the value obtained as a result of subtracting the second error value from the limited error value is a value obtained as a result of dividing, by a predetermined value, the value obtained as a result of subtracting the second error value from the limited error value.

* * * * *